US012038221B2

(12) United States Patent
Kang et al.

(10) Patent No.: US 12,038,221 B2
(45) Date of Patent: Jul. 16, 2024

(54) REFRIGERATOR

(71) Applicant: SAMSUNG ELECTRONICS CO., LTD., Suwon-si (KR)

(72) Inventors: Changgu Kang, Suwon-si (KR); Eun Heo, Suwon-si (KR); Junseong Lim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 227 days.

(21) Appl. No.: 17/691,461

(22) Filed: Mar. 10, 2022

(65) Prior Publication Data

US 2022/0364783 A1 Nov. 17, 2022

Related U.S. Application Data

(63) Continuation of application No. PCT/KR2022/002265, filed on Feb. 16, 2022.

(30) Foreign Application Priority Data

May 14, 2021 (KR) ..... 10-2021-0063024

(51) Int. Cl.
*F25D 17/04* (2006.01)
*F25D 23/06* (2006.01)

(52) U.S. Cl.
CPC ..... *F25D 17/045* (2013.01); *F25D 23/069* (2013.01); *F25D 2317/0671* (2013.01)

(58) Field of Classification Search
CPC ..... F25D 17/045; F25D 23/069; F25D 2317/0671; F25D 17/04; F25D 17/06;
(Continued)

(56) References Cited

U.S. PATENT DOCUMENTS 4,557,118 A * 12/1985 Pink ..... F25D 17/045 62/382
4,732,014 A * 3/1988 Frohbieter ..... F25D 11/02 62/382

(Continued)

FOREIGN PATENT DOCUMENTS

CN 106322909 A * 1/2017 ..... F25D 25/025
CN 107036363 A * 8/2017 ..... F25D 11/00

(Continued)

OTHER PUBLICATIONS

International Search Report dated Jun. 9, 2022 in International Patent Application No. PCT/KR2022/002265 (3 pages; 4 pages English translation).

(Continued)

*Primary Examiner* — Hanh V Tran
(74) *Attorney, Agent, or Firm* — STAAS & HALSEY LLP

(57) ABSTRACT

A refrigerator including a storage compartment, a storage box, and a cover assembly. The cover assembly including a cover member to cover an upper portion of the storage box, a frame provided along the cover member and configured to fix the cover member and comprising an opening provided to communicate with the discharge port to allow cold air to flow into the storage box, a knob configured to be movable and disposed on a side of the frame, a connecting member configured to slide inside the frame and connected to the knob, a guide member configured to be movable inside the frame based on a movement of the knob. The guide member comprising a guide hole, and an opening and closing member configured to open and close the opening by moving in a vertical direction along the guide hole.

15 Claims, 22 Drawing Sheets

(58) Field of Classification Search
CPC .. F25D 25/02; F25D 2317/061; F25D 25/025; F25D 17/065; F25D 25/021; F25D 2400/04; F25D 2500/02
See application file for complete search history.

(56) References Cited

U.S. PATENT DOCUMENTS

| | | | | | |
|---|---|---|---|---|---|
| 4,850,206 | A * | 7/1989 | Larsen | F25D 25/025 | 62/382 |
| 4,870,836 | A * | 10/1989 | Pink | F25D 17/065 | 62/382 |
| 5,540,492 | A * | 7/1996 | Dasher | F25D 25/021 | 62/449 |
| 5,901,562 | A * | 5/1999 | Tunzi | G05D 23/126 | 236/99 D |
| 6,363,738 | B2 * | 4/2002 | Nakajima | F25D 25/02 | 211/1.56 |
| 10,378,811 | B2 * | 8/2019 | Lee | F25D 17/065 | |
| 10,677,522 | B1 * | 6/2020 | Stauffer | F25D 17/045 | |
| 11,435,127 | B2 * | 9/2022 | Song | F25D 25/025 | |
| 11,821,671 | B2 * | 11/2023 | Heo | F25D 25/02 | |
| 2006/0005567 | A1 * | 1/2006 | Lee | F25D 25/021 | 62/408 |
| 2006/0199495 | A1 * | 9/2006 | Yamaguchi | A47F 3/001 | 454/173 |
| 2006/0248916 | A1 * | 11/2006 | Kim | F25D 25/025 | 62/187 |
| 2008/0246382 | A1 * | 10/2008 | Kang | A47B 57/06 | 312/408 |
| 2009/0199587 | A1 * | 8/2009 | Matthews | F25D 25/025 | 62/448 |
| 2013/0081421 | A1 * | 4/2013 | Kwon | F25D 23/025 | 62/440 |
| 2018/0156534 | A1 * | 6/2018 | Alyanak | F25D 25/025 | |
| 2018/0187966 | A1 * | 7/2018 | Lee | F25D 17/042 | |
| 2018/0274841 | A1 * | 9/2018 | Cizik | F25D 17/045 | |

FOREIGN PATENT DOCUMENTS

| | | | | | |
|---|---|---|---|---|---|
| CN | 107504755 | A * | 12/2017 | | |
| CN | 111197897 | A * | 5/2020 | F25D 11/02 | |
| CN | 210772950 | U * | 6/2020 | | |
| JP | H11270950 | A * | 10/1999 | | |
| KR | 20-0117772 | | 7/1998 | | |
| KR | 10-2001-0027235 | | 4/2001 | | |
| KR | 2002-0039195 | | 5/2002 | | |
| KR | 20050080684 | A * | 8/2005 | | |
| KR | 10-0593360 | | 6/2006 | | |
| KR | 10-2006-0115837 | | 11/2006 | | |
| KR | 10-2006-0128427 | | 12/2006 | | |
| KR | 20060128427 | A * | 12/2006 | | |
| KR | 20-2009-0006506 | | 7/2009 | | |
| KR | 100911272 | B1 * | 8/2009 | | |
| KR | 10-1060398 | | 8/2011 | | |
| KR | 20140054669 | A * | 5/2014 | | |
| KR | 10-2018-0080053 | | 7/2018 | | |
| KR | 10-2021-0026471 | | 3/2021 | | |
| KR | 10-2021-0136367 | | 11/2021 | | |
| TR | 201712056 | A2 * | 3/2019 | | |
| WO | WO-2014206807 | A1 * | 12/2014 | F25D 17/045 | |
| WO | WO-2015010980 | A1 * | 1/2015 | F25D 17/042 | |

OTHER PUBLICATIONS

Extended European Search Report dated Apr. 24, 2024 for corresponding application 22807586.7.

* cited by examiner

REFRIGERATOR

CROSS-REFERENCE TO RELATED APPLICATION

This application is a continuation application, under 35 U.S.C. § 111(a), of international application No. PCT/KR2022/002265, filed Feb. 16, 2022, which is based on and claims priority under 35 U. S. C. § 119 to Korean Patent Application No. 10-2021-0063024 filed on May 14, 2021, the disclosure of which is incorporated herein by reference in its entirety.

FIELD

The disclosure relates to a refrigerator, and more particularly, to a refrigerator including a cold air regulator including an improved structure.

DESCRIPTION OF RELATED ART

A refrigerator is a home appliance that is configured to keep food fresh by including a storage compartment for storing food and a cold air supply device supplying cold air to the storage compartment.

A temperature of the storage compartment is maintained at a temperature within a certain range required to keep the food fresh. The storage compartment of such a refrigerator is provided such that the front side thereof is opened, and the open front side is normally closed by a door so as to maintain the temperature of the storage compartment.

A shelf dividing the storage compartment into a plurality of spaces and a storage box accommodating food and the like are provided inside the storage compartment. Such a storage box includes an open top and is generally provided to be withdrawn from under the shelf.

In addition, by opening and closing an opening formed to introduce cold air into the storage box under the shelf, it is possible to adjust an internal temperature of the storage box according to the type of food stored therein. This may be performed in such a way that a user manipulates a knob at the front of the shelf so as to allow an opening and closing member connected to the knob to open and close the opening.

However, if a connecting member connecting the knob to the opening and closing member is formed across the shelf, the visibility of a lower side of the shelf may decrease and the aesthetic of the inside of the storage compartment may be degraded.

In addition, based on a size of the opening increases in order to supply a larger amount of cold air into the storage box, a moving distance of the opening and closing member for opening and closing is increased.

Accordingly, the moving distance of the knob connected to the opening and closing member is also increased, which may cause inconvenience when the user manipulates the knob.

SUMMARY

The disclosure relates to a refrigerator including a storage compartment provided to receive cold air through a discharge port, a storage box in which items are stored, and a cover unit provided above the storage box. The cover unit includes a cover member provided to cover an upper portion of the storage box, a frame provided on a rim of the cover member to fix the cover member, and including an opening provided to communicate with the discharge port to allow cold air to flow into the storage box, a knob provided to be movable by being operated from one side of the frame, a connecting member provided to slide inside the frame by including one end connected to the knob, a guide member provided to be movable inside the frame in association with a movement of the knob through the connecting member, the guide member including a guide hole, and an opening and closing member provided to open and close the opening by moving in a vertical direction along the guide hole of the guide member.

The guide member may include a body including a communicator provided to communicate with the opening, and the guide hole may be formed to be cut in the body to be inclined with respect to the storage compartment.

The opening and closing member may include a sealing plate provided to open and close the opening, and an interference protrusion extending from the sealing plate toward the guide member, the interference protrusion being inserted into the guide hole to be moved along the guide hole.

The opening and closing member may interfere with the guide hole to be vertically moved with respect to the frame according to a horizontal movement of the guide member.

The frame may include a slit formed on a bottom surface to allow the opening and closing member to pass therethrough and to be moved to an outside of the frame.

The frame may further include a fixing rib formed at both ends of the slit and extending from the bottom surface so as to prevent a lateral movement of the opening and closing member.

The frame may include an accommodating space formed by an inner wall, an outer wall, and a pair of partition walls to accommodate the guide member and the opening and closing member.

The opening of the frame may include a first opening formed in the outer wall of the frame, and a second opening formed in the inner wall of the frame.

The opening and closing member may be provided to be movable up and down between the guide member and the outer wall of the frame to open and close the first opening of the frame.

The storage box may further include a divider provided inside the storage box to divide an inside into a plurality of spaces.

One of the plurality of spaces of the storage box may be provided to selectively receive cold air from the discharge port and the opening.

The opening and closing member may be provided to be movable up and down at a rear side of the storage box.

The guide hole may include a plurality of curved portions to allow the interference protrusion of the opening and closing member to be inserted into the guide hole so as to adjust an area for opening the opening step by step.

The frame may include a first frame in which the connecting member, the guide member, and the opening and closing member are accommodated, and a second frame coupled to an upper portion of the first frame.

The first frame may include a guide rib extending toward the connecting member to allow the connecting member to move in contact with an inner surface of the first frame.

Another aspect of the present disclosure provides a refrigerator including a storage compartment provided to receive cold air through a discharge port, a cover member provided inside the storage compartment, a frame provided on a rim of the cover member to fix the cover member to an inside of the storage compartment, and including an opening provided to communicate with the discharge port, a storage box arranged below the frame to receive cold air from the opening, a knob provided to be movable by being operated from one side of the frame, a connecting member provided to slide inside the frame by including one end connected to the knob, a guide member provided to be horizontally movable inside the frame by being connected to the connecting member and including a guide hole cut from a lower portion of one side toward an upper portion of the other side, and an opening and closing member provided to be moved in a vertical direction along the horizontal movement of the guide member by being partially inserted into the guide hole, so as to open and close the opening.

The opening and closing member may include an interference protrusion inserted into the guide hole to be moved along the guide hole.

The frame may include a slit formed on a bottom surface to allow the opening and closing member to pass therethrough toward a lower side of the frame.

Another aspect of the present disclosure provides a refrigerator including a storage compartment provided to receive cold air through a discharge port, a cover unit mounted to the storage compartment, and a storage box arranged below the cover unit and including a first space and a second space separated from each other. The cover unit includes a cover member provided to cover an upper portion of the storage box, a frame provided to surround a rim of the cover member to fix the cover member, and including an opening provided to communicate with the discharge port to supply cold air to the first space, a knob provided to be operated in a horizontal direction on one side of the frame, a connecting member provided to slide inside the frame by including one end connected to the knob, a guide member provided to be movable in a first direction inside the frame in association with a movement of the knob through the connecting member, the guide member including a guide hole cut in a second direction, and an opening and closing member provided to open and close the opening to adjust a temperature of the first space, the opening and closing member provided to be inserted into the guide hole so as to be moved in a third direction according to the first direction-movement of the guide member.

The frame may include a slit formed on a bottom surface to allow the opening and closing member to pass therethrough toward an outside of the frame and to be moved in the third direction, and a fixing rib formed at both ends of the slit and extending from the bottom surface so as to prevent the opening and closing member from being moved in the first direction.

DETAILED DESCRIPTION

Figure 1:
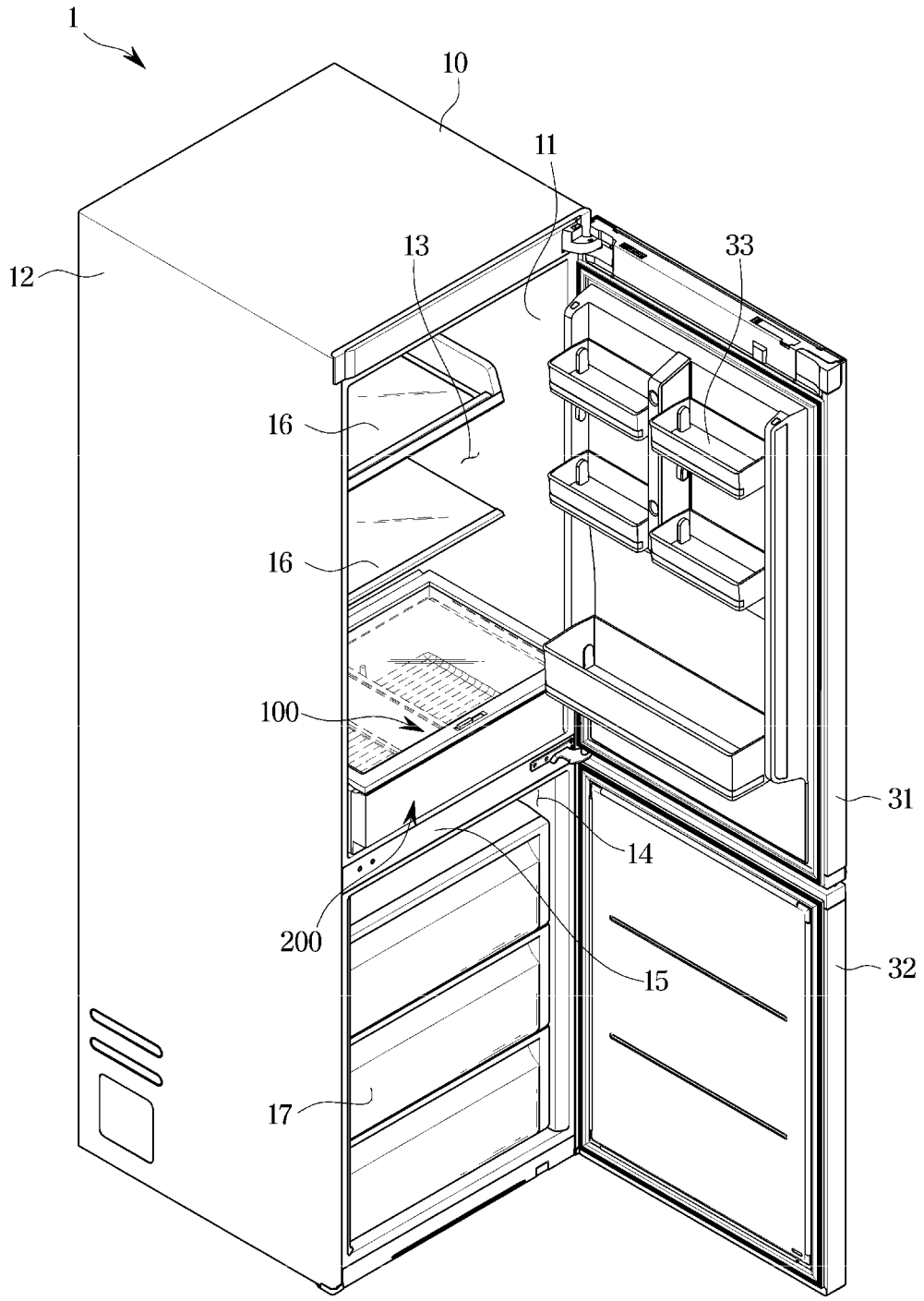
FIG. 1 is a perspective view of a refrigerator according to one embodiment of the present disclosure.

The disclosure is directed to a refrigerator including a cold air regulator including an improved structure for regulating an amount of cold air flowing into a storage box.

Further, the disclosure is directed to a refrigerator capable of dividing an inner space of a storage box to set each space to a different temperature.

Because a moving distance of a knob provided to control movement of an opening and closing member provided to open and close an opening is set to be less than an opening width of the opening through which cold air is introduced, it is possible to improve user's convenience in manipulating the knob.

Further, it is possible to efficiently manage the airflow flowing into a storage box because an amount of movement of a knob is kept constant and a size of an opening is designed to be large as needed.

Further, a cold air regulator is provided to move along a rim of a cover member, and thus it is possible to secure visibility of a lower side of the cover member, and to improve the aesthetic of an inside of a storage compartment.

Embodiments described in the disclosure and configurations illustrated in the drawings are merely examples of the embodiments of the disclosure, and may be modified in various different ways at the time of filing of the present application to replace the embodiments and drawings of the disclosure.

In addition, the same reference numerals or signs illustrated in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

The disclosure will be described more fully hereinafter with reference to the accompanying drawings.

FIG. 1 is a perspective view of a refrigerator according to one embodiment of the present disclosure.

Referring to FIG. 1, a refrigerator 1 may include a main body 10 and a plurality of storage compartments 13 provided in the main body 10 and including an open front to allow items to be inserted into or withdrawn from the refrigerator 1.

The refrigerator 1 may include a plurality of doors 31 and 32 rotatably coupled to the main body 10 to open and close the open front surfaces of the plurality of storage compartments 13, and a cold air regulator configured to supply cold air to the plurality of storage compartments 13.

The body 10 may include an inner case 11 and an outer case 12. The outer case 12 may form the exterior of the main body 10. The outer case 12 may be formed of a metal material having excellent durability and aesthetics.

The inner case 11 may be located inside the outer case 12. The inner case 11 may form the exterior of the storage compartment 13. The inner case 11 may be integrally injection-molded with a plastic material.

The plurality of storage compartments 13 may be divided into a first storage compartment 13 and a second storage compartment 14 by a partition wall 15. The first storage compartment 13 may be provided at an upper portion of the refrigerator 1, and the second storage compartment 14 may be provided at a lower portion of the refrigerator 1. Accordingly, the first storage compartment 13 may be referred to as an upper storage compartment and the second storage compartment 14 may be referred to as a lower storage compartment.

The plurality of storage compartments 13 may include a refrigerating compartment and a freezing compartment. Depending on the type of the refrigerator 1, the upper storage compartment 13 may be provided as a refrigerating compartment and the lower storage compartment may be provided as a freezing compartment. That is, the first storage compartment 13 may be provided as a refrigerating compartment and the second storage compartment 14 may be provided as a freezing compartment.

The refrigerator 1 according to one embodiment of the present disclosure illustrated in FIG. 1 is a Bottom Mounted Freezer (BMF) type refrigerator 1 in which the first storage compartment 13 is provided as the refrigerating compartment and the second storage compartment 14 is provided as the freezing compartment.

However, the type of the refrigerator 1 of the present disclosure is not limited thereto, and it may be applied to other types of refrigerators 1 as long as a storage box 200 is mountable in the storage compartment 13 such as the refrigerating compartment or the freezing compartment.

As another type of refrigerator 1, there is a Side By Side (SBS) type refrigerator 1 in which a freezing compartment and a refrigerating compartment are arranged left and right, or a Top Mounted Freezer (TMF) type refrigerator 1 in which a freezing compartment is arranged above the refrigerating compartment.

The freezing compartment may be maintained at approximately minus 20 degrees Celsius and the refrigerating compartment may be maintained at approximately 3 degrees Celsius. The freezing compartment and the refrigerating compartment may be insulated by the partition wall 15.

The plurality of storage compartments 13 may be opened and closed by the plurality of doors 31 and 32. The first storage compartment 13 may be opened and closed by a first door 31 rotatably coupled to the main body 10. The second storage compartment 14 may be opened and closed by a second door 32 rotatably coupled to the main body 10. However, the opening/closing method of the door is not limited thereto and may be provided in various ways as long as the door is configured to open and close the storage compartment 13.

A plurality of door guards 33 provided to accommodate items and the like may be provided on a rear surface of the first door 31. The door guard 33 may be provided to accommodate a small-volume item or the like.

A drawer 17 may be installed in the second storage compartment 14 to be withdrawn forward.

A variable shelf 16, on which items stored in the first storage compartment 13 may be mounted, may be provided in the first storage compartment 13. The variable shelf 16 may be provided in plurality and may be fixed to an inside of the first storage compartment 13 by beads (not shown) formed on the inner case 11. Further, the variable shelf 16 may be installed to have a variable height inside the first storage compartment 13.

Because the inside of the first storage compartment 13 is divided into multiple stages by the variable shelves 16 arranged to be spaced apart from each other in a vertical direction, it is possible to increase the efficiency of use of the storage space and to easily accommodate the items to be stored.

The refrigerator 1 may include a cover unit 100 (also referred to as a cover assembly 100) and a storage box 200 arranged under the cover unit 100.

The cover unit 100 may adjust a degree of cooling of the storage box 200 by adjusting a degree of opening of a first opening 123 communicating with a discharge port 60 provided to discharge cold air into the first storage compartment 13. Details thereof will be described later.

The cover unit 100 may be mounted inside the first storage compartment 13 in such a way that the cover unit 100 is mounted on a bead (not shown) formed on the inner case 11 of the main body 10. Alternatively, as the inner case 11 is recessed inward and the cover unit 100 is fitted thereto, the cover unit 100 may be fixed to the inside of the first storage compartment 13.

The storage box 200 may be provided to allow vegetables or fruits to be stored therein. The storage box 200 may be arranged under the cover unit 100 to be withdrawn forward. The storage box 200 may have a shape with an open upper surface.

Accordingly, a user can check items inside the storage box 200 through a transparent cover member 110 of the cover unit 100.

The cover unit 100 may include a cold air regulator 140 (refer to FIG. 5) to be described later. The cold air regulator 140 may be configured to regulate cold air supplied to the storage box 200. A user may control an internal temperature of the storage box 200 by manipulating the knob 141 provided in the front of the cover unit 100. Details thereof will be described later.

Figure 2:
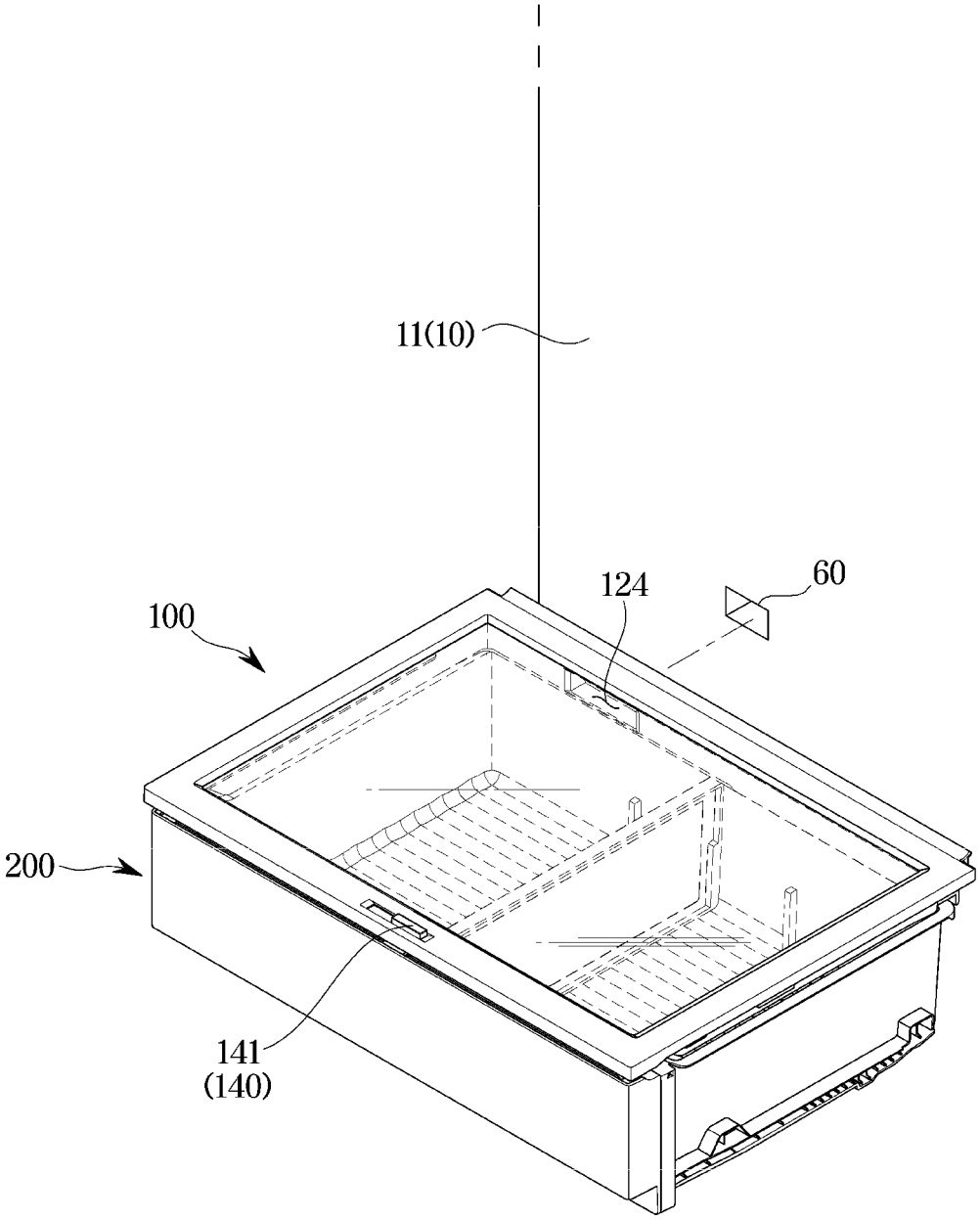
FIG. 2 is a view illustrating a cover unit, a storage box and a discharge port of an inner case of FIG. 1.
Figure 3:
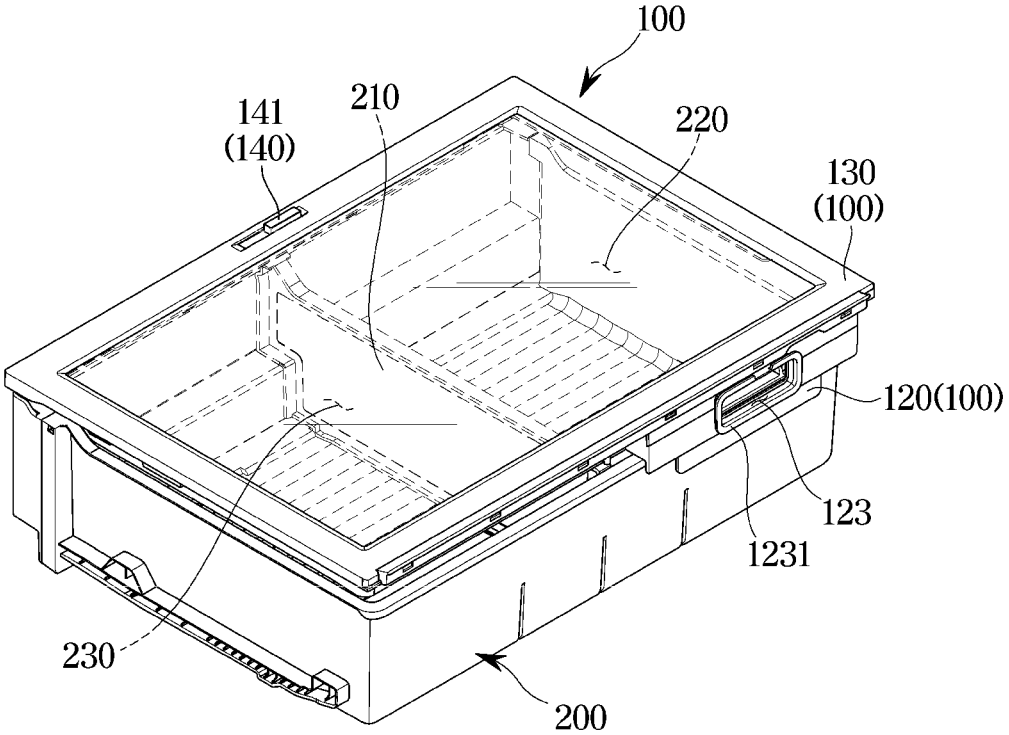
FIG. 3 is a rear-perspective view illustrating the cover unit and the storage box of FIG. 1.
Figure 4:
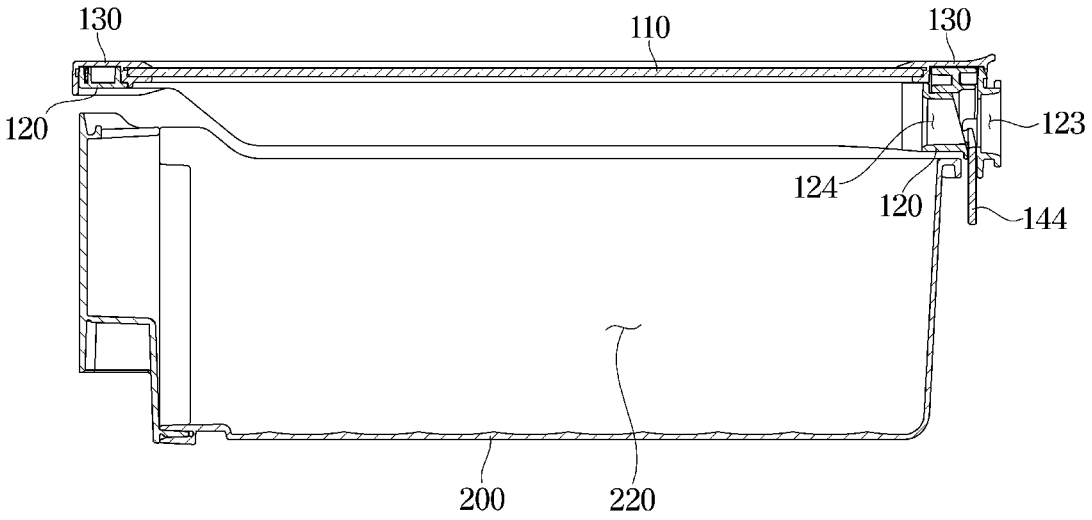
FIG. 4 is a cross-sectional view of the cover unit and the storage box of FIG. 1.

FIG. 2 is a view illustrating a cover unit, a storage box and a discharge port of an inner case of FIG. 1. FIG. 3 is a rear-perspective view illustrating the cover unit and the storage box of FIG. 1. FIG. 4 is a cross-sectional view of the cover unit and the storage box of FIG. 1.

Hereinafter the first storage compartment 13 referred to as the storage compartment 13 will be described.

Referring to FIGS. 2 to 4, the storage box 200 may be arranged under the cover unit 100.

The discharge port 60 provided to supply cold air into the storage compartment 13 may be formed in the inner case 11 of the refrigerator 1. However, the position of the discharge port 60 is not limited thereto, and may be formed in a separate duct coupled to the inner case 11.

The cover unit 100 may include the first opening 123 formed outside the cover unit 100 and a second opening 124 formed inside the cover unit 100, which allow the cold air discharged from the discharge port 60 to be introduced into the storage box 200. The first opening 123 and the second opening 124 may be formed in a first frame 120 of the cover unit 100.

The storage box 200 may include a first space 220 and a second space 230 divided by a divider 210. The cold air discharged from the discharge port 60 may flow through the first opening 123 and the second opening 124 of the first frame 120 and then be introduced into the first space 220 of the storage box 200.

In this case, an opening and closing member 144 of the cold air regulator 140 is configured to open and close the first opening 123 of the cover unit 100 so as to regulate an amount of cold air that is introduced from the discharge port 60 to the first space 220 of the storage box 200. The regulation of the cold air amount may be performed in such a way that the opening and closing member 144 is moved as a user manipulates the knob 144 from the front.

The opening and closing member 144 may be provided to be movable at the rear of the storage box 200 so as not to interfere with the storage box 200. In addition, as the storage box 200 is arranged in front of the opening and closing member 144, the operation of the opening and closing member 144 may not be exposed to the user, thereby improving the aesthetics. Details regarding the operation of the cold air regulator 140 will be described later.

Figure 5:
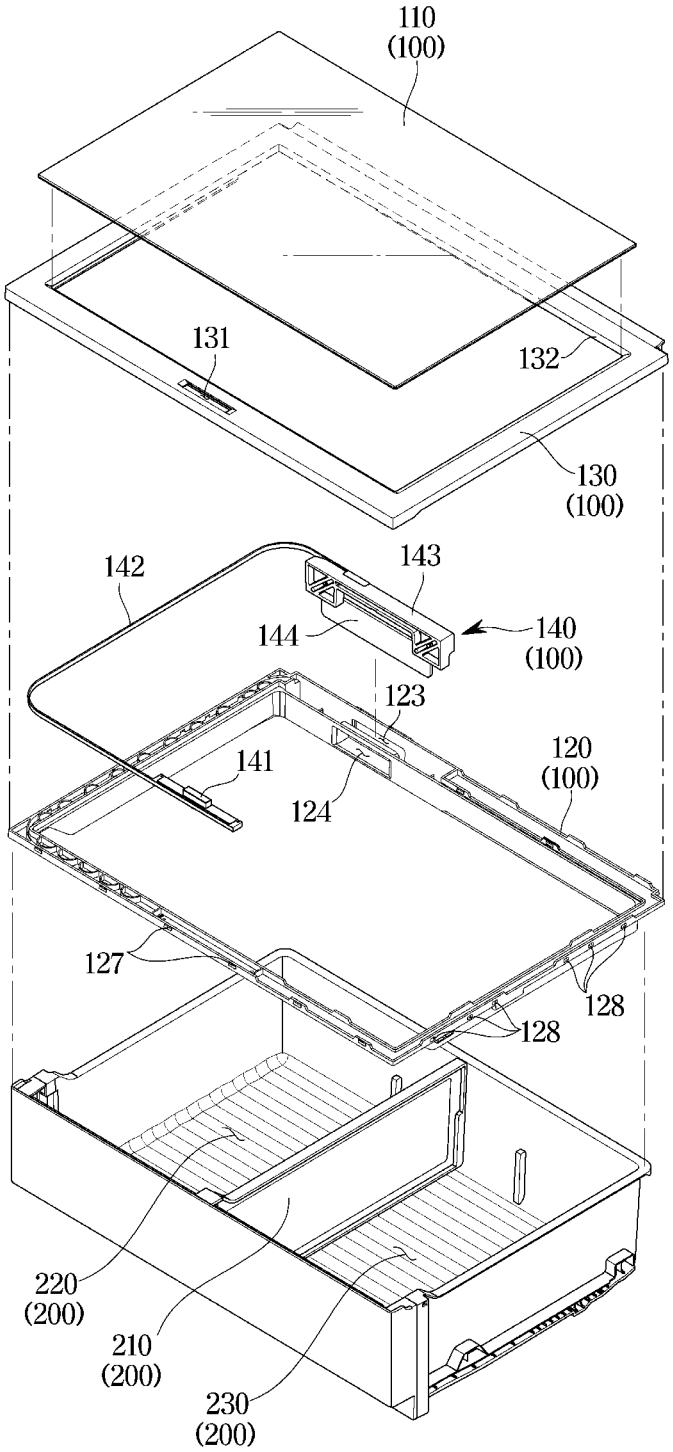
FIG. 5 is an exploded perspective view of the cover unit and the storage box of FIG. 1.

FIG. 5 is an exploded perspective view of the cover unit and the storage box of FIG. 1.

Referring to FIG. 5, the cover unit 100 of the refrigerator 1 according to one embodiment of the present disclosure may include a cover member 110, frames 120 and 130, and the cold air regulator 140. The cold air regulator 140 may be accommodated in the frames 120 and 130 to be slidable.

Under the cover unit 100, the storage box 200 may be provided to be withdrawn forward. The cover unit 100 may be provided to simply cover an upper portion of the storage box 200. In addition, an upper surface of the cover unit 100 may be provided to allow items to be placed thereon.

The cover member 110 may be provided to cover the upper portion of the storage box 200. In addition, the cover member 110 may be provided to allow items stored inside the storage compartment 13 to be placed thereon. The cover member 110 may be provided in a substantially rectangular shape. The cover member 110 may form a central portion of the cover unit 100.

The cover member 110 may include a transparent material such as glass. Therefore, a user can easily check a state of the lower side of the cover member 110. The cover member 110 may be supported by the frames 120 and 130 to be fixed inside the storage compartment 13.

The frames 120 and 130 may include the first frame 120 and a second frame 130. The first frame 120 may be provided under the frame 130. The second frame 130 may be coupled to an upper portion of the first frame 120.

The first frame 120 and the second frame 130 may be vertically coupled to each other, thereby having a substantially rectangular ring shape. The frames 120 and 130 may be provided on a rim of the cover member 110 to fix the cover member 110 to the inside of the storage compartment 13. In other words, the first frame 120 and the second frame 130 may form the rim of the cover member 110.

The cold air regulator 140 may be accommodated in the first frame 120. The cold air regulator 140 may be provided to be movable with respect to the first frame 120. Particularly, the cold air regulator 140 may be provided to slide with respect to the first frame 120.

The second frame 130 may be provided to cover an upper portion of the cold air regulator 140 moving inside the first frame 120. Accordingly, it is possible to prevent the cold air regulator 140 from being separated from the first frame 120 when the cold air regulator 140 is moved.

The cold air regulator 140 may be accommodated in a space formed by the first frame 120 and the second frame 130 to move. However, the opening and closing member 144 of the cold air regulator 140 may be provided to be exposed to the lower side of the frames 120 and 130.

The opening and closing member 144 of the cold air regulator 140 may be provided to open and close between the first opening 123 and the second opening 124 formed in the first frame 120, so as to regulate the amount of cold air introduced into the storage box 200.

The second frame 130 may include a knob through hole 131 that is cut out to allow a user to manipulate the cold air regulator 140 from the outside of the cover member 110.

Particularly, the knob 141 may pass through the knob through hole 131 and thus a portion of the knob 141 may protrude to the outside of the cover unit 100. The knob through hole 131 may be formed in a front center of an upper surface of the second frame 130. Accordingly, a user can manipulate the cold air regulator 140 from the front of the storage compartment 13.

However, the position of the knob through hole 131 is not limited thereto, and may be formed at a position anywhere other than the upper surface of the second frame 130 as long as being accessible by a user.

Accordingly, the knob 141 may be provided to be movable as much as a cut width of the knob through hole 131.

That is, the moving distance may be limited within a length defined by the knob through hole 131.

A detailed description of the cold air regulator 140 will be described later.

The storage box 200 may include the divider 210. The divider 210 may be provided inside the storage box 200 to divide the inside of the storage box 200 into a plurality of spaces. The space inside the storage box 200 may be divided into the first space 220 and the second space 230 by the divider 210.

FIG. 5 illustrates that the storage box 200 of the refrigerator 1 according to one embodiment of the present disclosure includes only the first space 220 and the second space 230, but the number of divided spaces is not be limited thereto.

Figure 6:
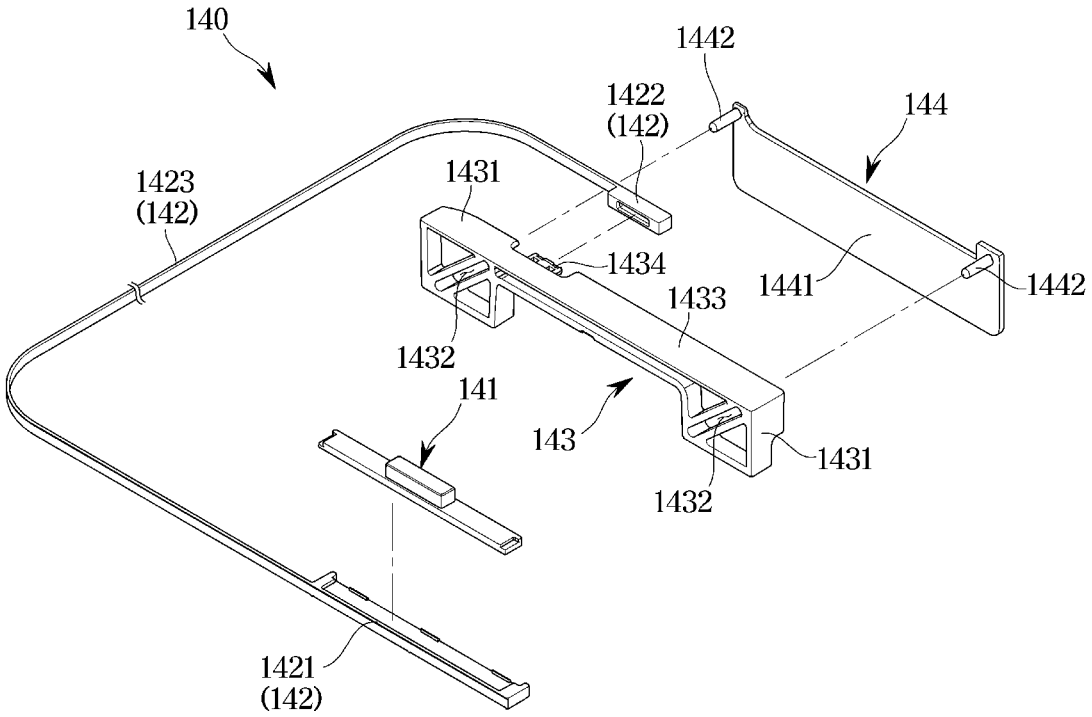
FIG. 6 is an exploded perspective view of a cold air regulator of FIG. 5.

FIG. 6 is an exploded perspective view of a cold air regulator of FIG. 5.

Referring to FIG. 6, the cold air regulator 140 may include the knob 141, a connecting member 142, a guide member 143, and the opening and closing member 144 provided to open and close the first opening 123.

The knob 141 may be provided in a front portion of the cover unit 100 to be gripped by a user. The knob 141 may be provided to be movable by being manipulated from one side of the frame. As illustrated in FIG. 1, the knob 141 may be exposed to the user through the knob through hole 131 of the second frame 130.

The connecting member 142 may be provided to slide inside the frames 120 and 130 by including one end thereof connected to the knob 141. The connecting member 142 may be provided in a shape that is elongated along an extending direction of the frames 120 and 130. The connecting member 142 may include a first connector 1421, a second connector 1422, and a third connector 1423.

The first connector 1421 may be formed at one end of the connecting member 142 to be coupled to the knob 141. The second connector 1422 may be formed at the other end of the connecting member 142 to be coupled to the guide member 143. The third connector 1423 may be provided between the first connector 1421 and the second connector 1422.

In the case of the connecting member 142 illustrated in FIG. 6, the connecting member 142 may be provided in an approximately '⊏' or bracket-shape and movably mounted inside the frames 120 and 130. However, the shape of the connecting member 142 may not be limited thereto.

The connecting member 142 may be formed of a material having a certain of thickness and weight, and thus the connecting member 142 may accurately transmit a force applied to the knob 141 to the guide member 143. In addition, the connecting member 142 may be formed of a material such as Poly Oxy Methylene (POM), nylon, or Polyketone that is resistant to deformation and abrasion. Because the connecting member 142 is movable in contact between plurality of guide ribs 126 and the frames 120 and 130, the connecting member 142 may be formed of a material having a self-lubricating component that is easy to move.

The guide member 143 may be connected to the second connector 1422 of the connecting member 142. The guide member 143 may be provided to move inside the frames 120 and 130 in association with the movement of the knob 141 through the connecting member 142.

The opening and closing member 144 may be connected to the guide member 143 to be movable relative to the guide member 143. Particularly, as the guide member 143 is moved, the opening and closing member 144 may be connected to the guide member 143 so as to be moved in a direction perpendicular to a moving direction of the guide member 143.

The cold air regulator 140 of the refrigerator 1 according to one embodiment of the present disclosure is provided in a '⊏' shape to be accommodated on the left side of the frames 120 and 130 when viewed from the front. However, the present disclosure is not limited thereto, and the cold air regulator 140 may be provided in an inverted '⊏' shape provided on the right side of the frames 120 and 130 with respect to the front side. In this case, the plurality of guide ribs 126 to be described later may be formed on the right side of the first frame 120.

In addition, because the position of the knob through hole 131 is not limited thereto, the knob through hole 131 of the frames 120 and 130 may be formed on a lateral side of the upper surface of the second frame 130. In this case, the connecting member 142 may be provided in a 'L' shape to have a shorter length.

Alternatively, the shape of the connecting member 142 of the cold air regulator 140 of the present disclosure may be provided in a closed ring shape along the entire first frame 120. In this case, the plurality of guide ribs 126 may be formed on front, rear left and right sides of the first frame 120. Accordingly, an external force applied to the knob 141 may be transmitted to the guide member 143 more reliably.

Accordingly, the shape of the cold air regulator 140 of the present disclosure is not limited to that illustrated in FIGS. 5 and 6.

Figure 7:
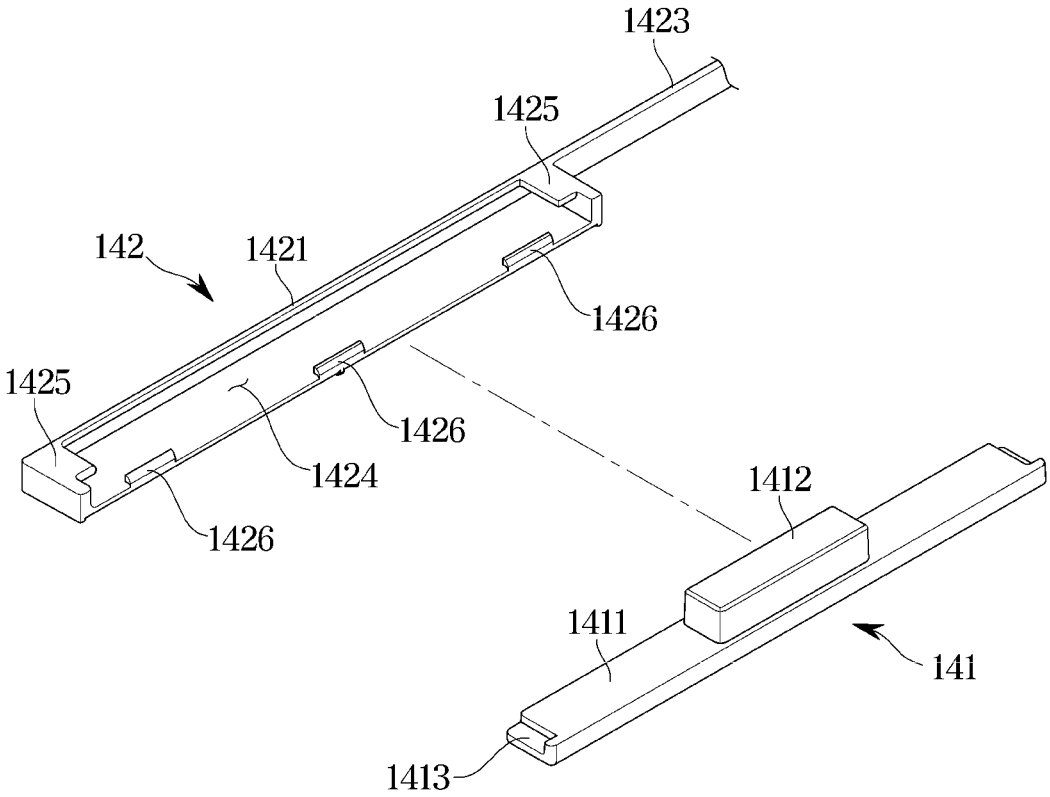
FIG. 7 is a view illustrating coupling of a knob and a connecting member of the refrigerator according to one embodiment of the present disclosure.
Figure 8:
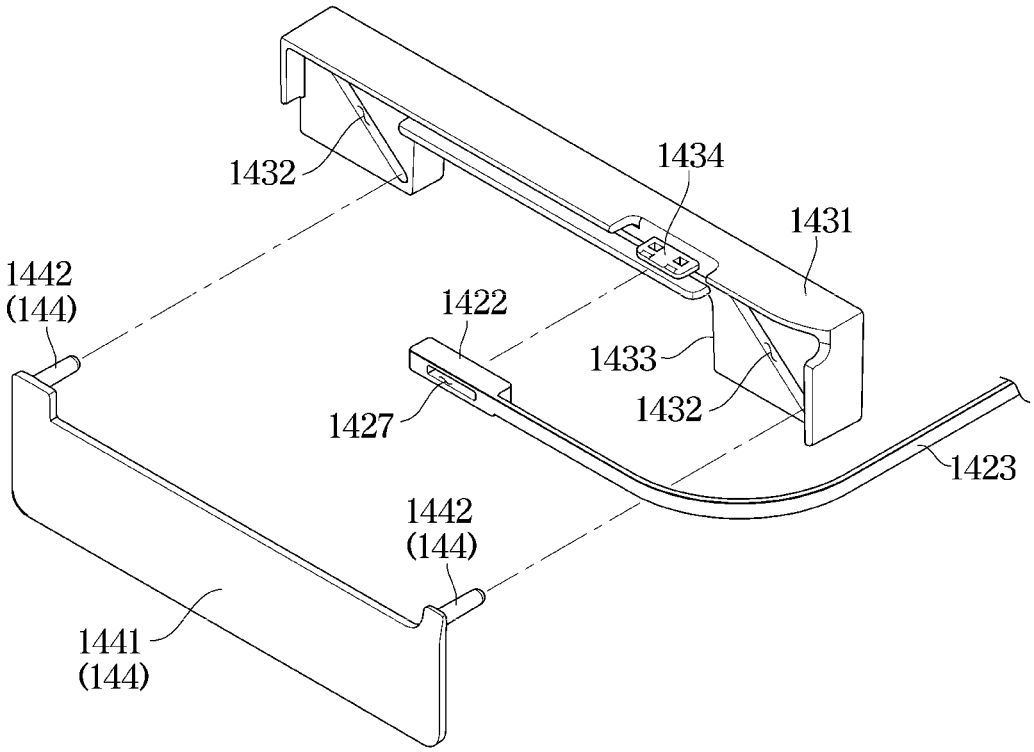
FIG. 8 is a view illustrating coupling of the connecting member, a guide member, and an opening and closing member of the refrigerator according to one embodiment of the present disclosure.

FIG. 7 is a view illustrating coupling of a knob and a connecting member of the refrigerator according to one embodiment of the present disclosure. FIG. 8 is a view illustrating coupling of the connecting member, a guide member, and an opening and closing member of the refrigerator according to one embodiment of the present disclosure.

Referring to FIG. 7, the knob 141 may include a knob body 1411 mounted on the connecting member 142, a grip 1412 protruding from the knob body 1411, and a stepped portion 1413 formed in the both ends of the knob body 1411.

The connecting member 142 may include the first connector 1421 formed at one end in a longitudinal direction. The first connector 1421 may be connected to the third connector 1423 to have a substantially cut-out box shape. A first accommodating space 1212 may be formed inside the first connector 1421 to accommodate the knob 141.

The knob body 1411 may be mounted inside the connecting member 142 to transmit the movement of the knob 141 to the connecting member 142. The grip 1412 is provided to extend upwardly from the upper surface of the knob body 1411 to be gripped by a user.

The first connector 1421 of the connecting member 142 may include a supporter 1425 provided in a shape corresponding to the stepped portion 1413 of the knob 141. The supporter 1425 may be formed at both ends of the first connector 1421 and extend toward the knob 141 to be parallel to the upper surface of the knob body 1411.

In addition, the first connector 1421 of the connecting member 142 may include at least one locking portion 1426 formed on a side into which the knob 141 is inserted. The at least one locking portion 1426 may be formed to extend upwardly from a bottom surface of the first connector 1421. In one embodiment of the present disclosure, although it is illustrated that three locking portions 1426 are formed, the number of the locking portions 1426 is not limited thereto.

Accordingly, the knob 141 is inserted into the first accommodating space 1212 formed in the connecting member 142, and thus an upward movement of the knob 141 may be limited by the supporter 1425 of the connecting member 142. In addition, a backward movement of the knob 141 may be limited by the at least one locking portion 1426 of the connecting member 142. That is, the connecting member 142 and the knob 141 may be coupled to prevent the knob 141 from being separated from the connecting member 142.

In addition, because the supporter 1425 of the connecting member 142 is provided in a shape corresponding to the stepped portion 1413 of the knob 141, the upper surface of the supporter 1425 of the connecting member 142 and the upper surface of the knob body 1411 may be provided at the same height.

The knob 141 of the cold air regulator 140 is a component exposed to a user, and in an embodiment of the present disclosure, the knob 141 and the connecting member 142 are formed as a separate component and then coupled to each other. Accordingly, it is possible to change a color and shape of the knob 141 according to a design upon producing products.

Referring to FIG. 8, the connecting member 142 may include the second connector 1422 connected to the third connector 1423. The second connector 1422 may be formed at the other end of the connecting member 142 in the longitudinal direction. The second connector 1422 may be provided in a substantially hollow ring shape. A coupler insertion hole 1427 may be formed in the second connector 1422 to allow a coupler 1434 of the guide member 143 described later to be inserted thereto.

The guide member 143 may include a body 1431 including a communicator 1433, and a guide hole 1432 cut in the body 1431.

The communicator 1433 may be provided to communicate with the first opening 123 and the second opening 124 of the frame. Accordingly, the cold air discharged through the discharge port 60 may be introduced into the storage box 200 through the first opening 123 of the frame, the communicator 1433 of the guide member 143, and the second opening 124 of the frame.

The guide hole 1432 of the guide member 143 may be formed by being cut in the body 1431 to be inclined with respect to the storage compartment 13. Particularly, the guide hole 1432 may be cut from a lower portion of one side of the guide member 143 toward an upper portion of the other side. An interference protrusion 1442 of the opening and closing member 144 to be described later may be inserted into the guide hole 1432.

The guide member 143 may include the coupler 1434. The coupler 1434 may be inserted into the coupler insertion hole 1427 of the connecting member 142. The coupler insertion hole 1427 formed in the connecting member 142 may be provided to have the same size or slightly smaller than a cross-section of the coupler 1434 of the guide member 143. Accordingly, as the connecting member 142 is fitted to the coupler 1434 of the guide member 143, the movement of the connecting member 142 may be easily transmitted to the guide member 143.

The opening and closing member 144 may include a sealing plate 1441 and the interference protrusion 1442.

The sealing plate 1441 may be provided to open and close the first opening 123. Accordingly, a size of the sealing plate 1441 may be formed to be larger than the first opening 123 so as to sufficiently cover the first opening 123. However, the size of the sealing plate 1441 is not limited thereto, and thus the size of the sealing plate 1441 may be the same as that of the first opening 123.

The interference protrusion 1442 may extend from the sealing plate 1441 toward the guide member 143. The interference protrusion 1442 may be inserted into the guide hole 1432 of the guide member 143 so as to be movable therein.

In addition, FIG. 8 illustrates two guide holes 1432 of the guide member 143 and two interference protrusions 1442 of the opening and closing member 144 inserted therein, but the number of the guide hole 1432 and the interference protrusion 1442 is not limited thereto. For example, one or three or more of the guide hole 1432 and the interference protrusion 1442 may be formed.

As the guide member 143 is moved in the horizontal direction, the opening and closing member 144 may be provided to be moved in the vertical direction. Details thereof will be described later.

It has been described that the knob 141, the connecting member 142, and the guide member 143 of the refrigerator 1 according to one embodiment of the present disclosure are formed as a separate component and then coupled to each other, but the present disclosure is not limited thereto. Alternatively, the components may be injection molded. In addition, the connecting member 142 and the knob 141 may be integrally formed and the guide member 143 may be separately coupled thereto, or the connecting member 142 and the guide member 143 may be integrally formed and the knob 141 may be separately coupled thereto.

Figure 9:
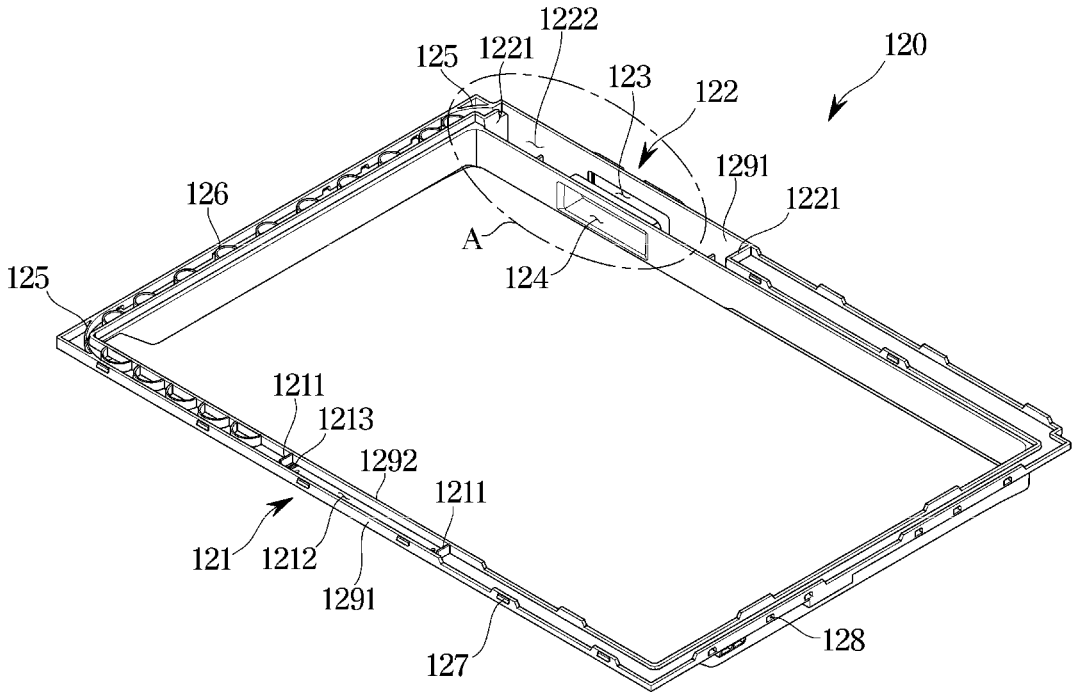
FIG. 9 is a perspective view of a first frame of FIG. 5.
Figure 10:
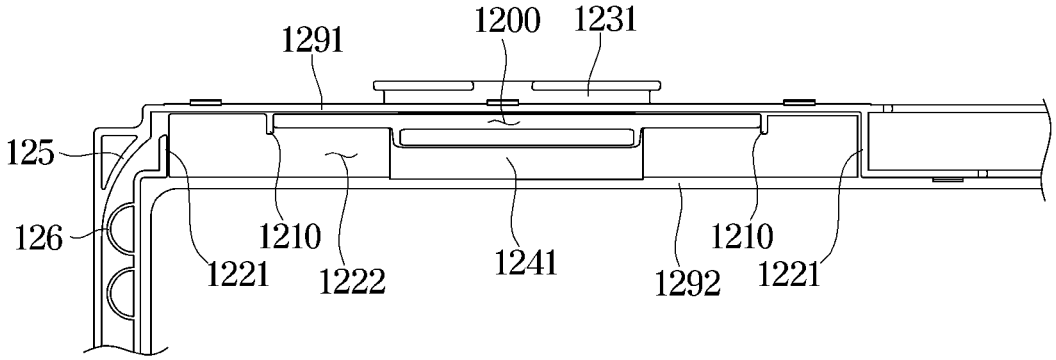
FIG. 10 is a top view illustrating a portion A of FIG. 9.

FIG. 9 is a perspective view of a first frame of FIG. 5. FIG. 10 is a top view illustrating a portion A of FIG. 9.

Referring to FIG. 9, the first frame 120 may include a first accommodating portion 121 and a second accommodating portion 122.

The first accommodating portion 121 may be provided to accommodate the knob 141 and the first connector 1421 of the connecting member 142 connected thereto.

The first accommodating portion 121 may include the first accommodating space 1212 formed by an inner wall 1292, an outer wall 1291, and a pair of first partition walls 1211 of the first frame 120. The knob 141 and the first connector 1421 may be accommodated in the first accommodating space 1212 to be movable with respect to the first frame 120.

A drain hole 1213 may be formed in a bottom surface of the first accommodating portion 121. Water or foreign substances condensed on the upper surface of the cover member 110 may be discharged through the drain hole 1213.

The second accommodating portion 122 may be provided to accommodate the guide member 143, the opening and closing member 144, and the second connector 1422 of the connecting member 142.

The second accommodating portion 122 may include a second accommodating space 1222 formed by the inner wall 1292, the outer wall 1291, and a pair of second partition walls 1221 of the first frame 120. The guide member 143 may be accommodated in the second accommodating space 1222 to be movable with respect to the second frame 130.

The first frame 120 may include the first opening 123 and the second opening 124.

The first opening 123 and the second opening 124 may be formed in the second accommodating portion 122. Particularly, the first opening 123 may be formed in the outer wall 1291 of the first frame 120, and the second opening 124 may be formed in the inner wall 1292 of the first frame 120. The first opening 123 and the second opening 124 may form a flow path through which the cold air discharged from the discharge port 60 may flow to the storage box 200. In addition, because the guide member 143 is arranged between the first opening 123 and the second opening 124, the communicator 1433 of the guide member 143 may also form the flow path through which cold air flows.

The first frame 120 may include the plurality of guide ribs 126 and a curved portion 125.

The plurality of guide ribs 126 may be provided to guide the sliding movement of the connecting member 142. The plurality of guide ribs 126 may extend from the inside of the first frame 120 toward the outer wall 1291 of the first frame 120. The plurality of guide ribs 126 may be formed between the first accommodating portion 121 and the second accommodating portion 122 to assist the movement of the connecting member 142.

The plurality of guide ribs 126 may extend upward from the bottom surface of the first frame 120. This extends in a direction perpendicular to the moving direction of the connecting member 142 to be described later, and is provided to press one side of the connecting member 142.

The plurality of guide ribs 126 may be formed to be spaced apart from each other. The connecting member 142 may be inserted between the plurality of guide ribs 126 and the outer wall 1291 of the first frame 120. Accordingly, the connecting member 142 may be moved in contact between the plurality of guide ribs 126 and the outer wall 1291 of the first frame 120.

Because the plurality of guide ribs 126 is formed to be spaced apart from each other, a contact area with the connecting member 142 may be reduced in comparison with forming the guide ribs 126 integrally.

In addition, by forming the guide rib 126 in a curved shape to be in contact with the connecting member 142, it is possible to minimize a contact area between the connecting member 142 and the guide rib 126.

Accordingly, a frictional force between the connecting member 142 and the guide rib 126 is minimized and thus the connecting member 142 may be moved smoothly inside the first frame 120. In addition, the plurality of guide ribs 126 assist the movement of the connecting member 142 according to the operation of the knob 141, thereby preventing the connecting member 142 from being bent. Accordingly, a user can accurately transmit the force acting on the knob 141 to the guide member 143 through the connecting member 142.

The curved portion 125 may extend upwardly from the bottom surface of the first frame 120 and may be formed to have a curved shape on a corner side of the first frame 120. Accordingly, the connecting member 142 may be supported by the curved portion 125 and then gently bent to slide inside the first frame 120.

In addition, although it is illustrated that the plurality of guide ribs 126 is formed in a substantially semicircular shape, the present disclosure is not limited thereto and may be provided in a linear shape.

When the plurality of guide ribs 126 is formed in a linear shape, the plurality of guide ribs 126 formed in a linear shape may extend toward the connecting member 142 and may be formed to be spaced apart from each other in the longitudinal direction of the connecting member 142. That is, each end of the plurality of guide ribs 126 may press the connecting member 142 to assist the movement of the connecting member 142. Even in this case, the frictional force between the connecting member 142 and the guide rib 126 is minimized, and thus it is possible to improve the user operation convenience.

In addition, it is illustrated that the guide rib 126 is formed in the linear shape, but is not limited thereto, and thus the guide rib 126 may be formed in either a straight line or a curved line. As long as the guide rib 126 presses the connecting member 142 with a minimum contact area, the shape of the guide rib 126 may vary.

In addition, the connecting member 142 of the refrigerator 1 according to one embodiment of the present disclosure may be changed to be moved so as to be in contact with the inner wall 1292 instead of the outer wall 1291 of the first frame 120. In this case, the plurality of guide ribs 126 may have a shape obtained by inverting the semicircle illustrated in FIG. 9 by approximately 180 degrees, and may be provided in a form extending from the outer wall 1291 to the inner wall 1292 of the first frame 120.

The first frame 120 may include a coupling protrusion 127 and a coupling hole 128.

The first frame 120 may include a plurality of coupling protrusions 127 and a plurality of coupling holes 128. The second frame 130 may also include a plurality of holes (not shown) and a plurality of hooks (not shown) corresponding thereto.

The plurality of coupling protrusions 127 may be provided to protrude outward from the outer wall 1291 of the first frame 120. The plurality of coupling holes 128 may be formed by cutting a portion of the outer wall 1291 of the first frame 120. The plurality of coupling protrusions 127 formed in the first frame 120 may be inserted into the plurality of holes (not shown) formed in the second frame 130, and the plurality of hooks (not shown) formed in the second frame 130 may be inserted into and coupled to the plurality of coupling holes 128. Accordingly, the first frame 120 and the second frame 130 may be firmly coupled without a separate fastening member. However, a separate fastening member may be coupled for more reliable coupling.

Referring to FIGS. 9 and 10, the first frame 120 may include a slit 1200 and a fixing rib 1210.

As illustrated in FIG. 10, the second accommodating portion 122 may include the slit 1200 formed on a bottom surface to allow the opening and closing member 144 to pass therethrough and to be moved to an outside of the frame.

The guide member 143 is a component accommodated inside the second accommodating portion 122 and not exposed to the outside, but the opening and closing member 144 is a component that is moved in the vertical direction with respect to the cover member 110 by interfering with the guide hole 1432 of the guide member 143. Accordingly, the opening and closing member 144 may be moved to protrude downward of the first frame 120.

Accordingly, the slit 1200 may be formed to have a width corresponding to a width in a horizontal direction of the opening and closing member 144. Alternatively, the slit 1200 may be formed slightly larger than the horizontal width.

The first frame 120 may include the fixing rib 1210 provided to prevent the opening and closing member 144 from moving laterally in response to passing through the slit 1200.

The fixing rib 1210 may be formed at both ends of the slit 1200. The fixing rib 1210 may extend upward from the bottom surface of the first frame 120.

Accordingly, the opening and closing member 144 may not be moved in the horizontal direction, but may be moved only in the vertical direction. In addition, because the fixing rib 1210 supports the lateral side of the opening and closing member 144, the opening and closing member 144 may open and close the first opening 123 more stably.

The first frame 120 may include a first duct 1231 forming the first opening 123 and extending rearward of the first frame 120. The first duct 1231 may form a flow path through which the cold air discharged from the discharge port 60 flows. Although not shown, a packing member may be coupled to a rear portion of the first duct 1231. Accordingly, a space between the discharge port 60 and the first opening 123 may be more reliably shielded to allow cold air to flow into the storage box 200.

The first frame 120 may include a second duct 1241 forming the second opening 124 and extending rearward from the inner wall 1292 of the first frame 120. The second duct 1241 may form a flow path through which the cold air, which is moved to the first opening 123 by flowing through the first duct 1231, flows.

It has been described that the opening and closing member 144 is provided to open and close the first opening 123 of the first frame 120. However, the opening and closing member 144 may be provided to open and close the second opening 124. In this case, the interference protrusion 1442 of the opening and closing member 144 may extend rearward and be inserted into the guide hole 1432 of the guide member 143.

Hereinafter the operation of the cold air regulator 140 of the refrigerator 1 according to an embodiment of the present disclosure will be described through various views.

Figure 11:
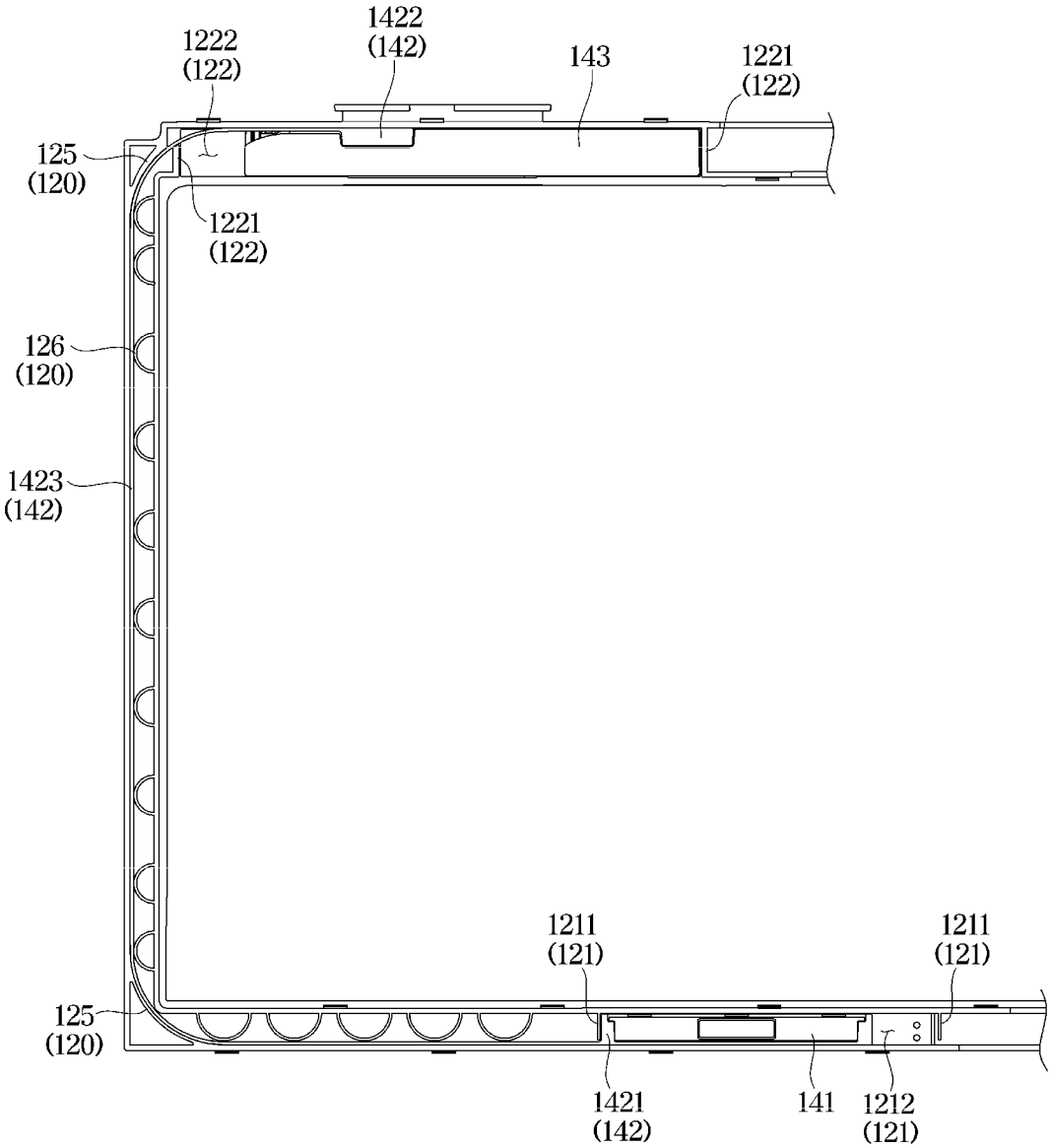
FIG. 11 is a top view illustrating a state, in which the cold air regulator, in a first state, of the refrigerator according to one embodiment of the present disclosure is accommodated in a first frame.
Figure 12:
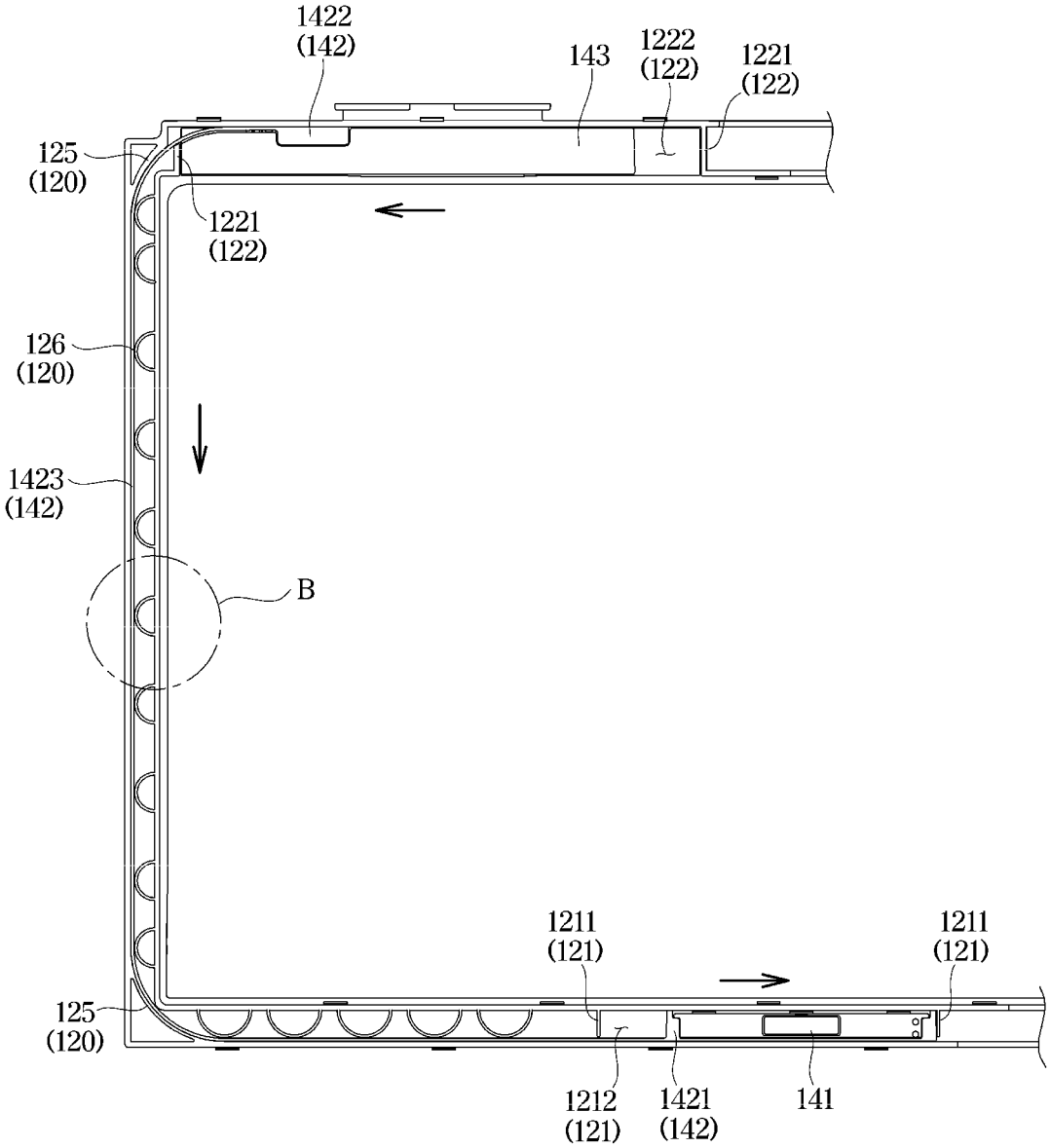
FIG. 12 is a top view illustrating a state, in which the cold air regulator, in a second state, of the refrigerator according to one embodiment of the present disclosure is accommodated in the first frame.
Figure 13:
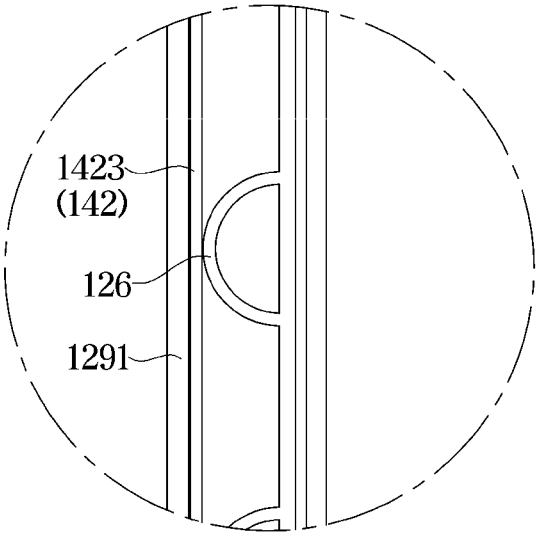
FIG. 13 is an enlarged view of a portion B of FIG. 12.

FIG. 11 is a top view illustrating a state, in which the cold air regulator, in a first state, of the refrigerator according to one embodiment of the present disclosure is accommodated in a first frame. FIG. 12 is a top view illustrating a state, in which the cold air regulator, in a second state, of the refrigerator according to one embodiment of the present disclosure is accommodated in the first frame. FIG. 13 is an enlarged view of a portion B of FIG. 12.

Referring to FIGS. 11 and 12, the cold air regulator 140 may be accommodated in the first frame 120 and moved in the horizontal direction.

The connecting member 142 of the cold air regulator 140 is accommodated in the first frame 120 along the extending direction of the first frame 120. The knob 141 may be connected to one end of the connecting member 142 and the guide member 143 may be connected to the other end of the connecting member 142. Accordingly, in conjunction with the movement of the knob 141, the connecting member 142 and the guide member 143 may be provided to slide in the horizontal direction with respect to the frames 120 and 130.

As illustrated in FIG. 11, a state, in which the knob 141 is moved to the left inside the first accommodating space 1212 of the first frame 120, is referred to as a first state. In this case, the guide member 143 connected to the knob 141 by the connecting member 142 is in a state of being moved to the right inside the second accommodating space 1222 of the first frame 120.

The first state is a state in which the opening and closing member 144 opens the first opening 123, and cold air is separately supplied to the first space 220 of the storage box 200. Because the second space 230 of the storage box 200 is separated from the first space 220 by the divider 210, the first space 220 may be maintained at a relatively lower temperature than the second space 230. Therefore, a dual mode of the storage box 200, in which the first space 220 and the second space 230 are provided at different temperatures, may be implemented in the first state.

In addition, in the first state or dual mode, cold air may be supplied to the first space 220 of the storage box 200, and in response to reaching a predetermined temperature, the cold air may not be supplied to the first space 220 of the storage box 200. Accordingly, the refrigerator 1 may include a controller (not shown) configured to uniformly maintain the temperature inside the first space 220 of the storage box 200.

As illustrated in FIG. 12, a state, in which the knob 141 is moved to the right inside the first accommodating space 1212 of the first frame 120, is referred to as a second state. In this case, the guide member 143 connected to the knob 141 by the connecting member 142 is moved from the right to the left of the second accommodating space 1222 of the first frame 120 according to the movement of the knob 141.

The second state is a state in which the opening and closing member 144 closes the first opening 123, and cold air is not supplied to the first space 220 of the storage box 200. Therefore, a single mode, in which the first space 220 and the second space 230 of the storage box 200 are provided at the same temperature, may be implemented.

Referring to FIG. 13, the connecting member 142 may be moved inside the first frame 120 in a state in contact between the outer wall 1291 of the first frame 120 and the guide rib 126. Accordingly, the manipulation of the knob 141 may be accurately transmitted to the guide member 143 while minimizing the loss of force applied to the connecting member 142.

Figure 14:
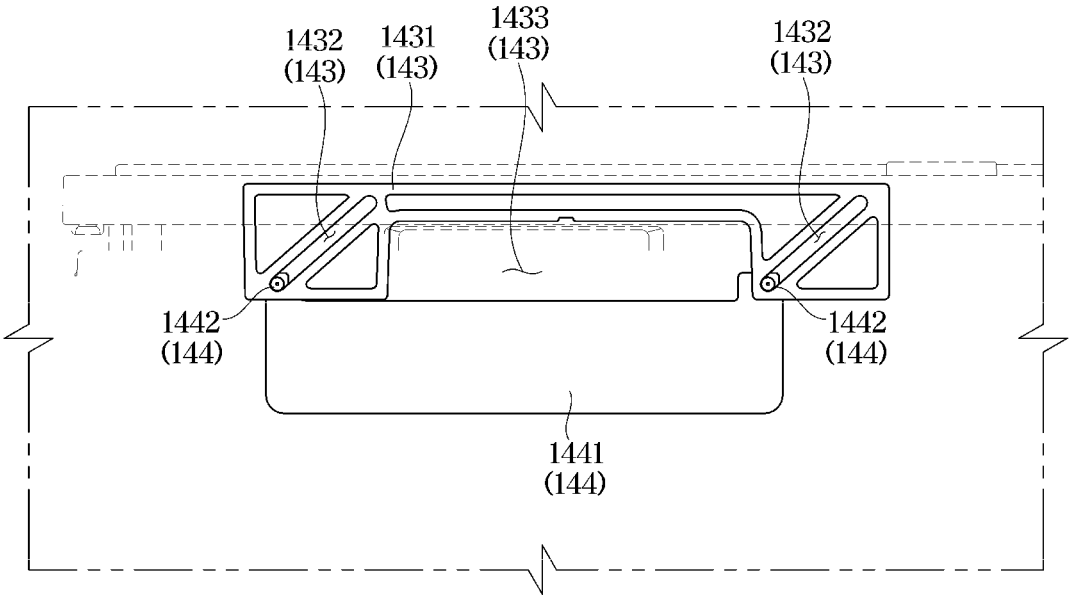
FIG. 14 is a front view illustrating a relationship between the guide member and the opening and closing member in the first state as illustrated in FIG. 11.
Figure 15:
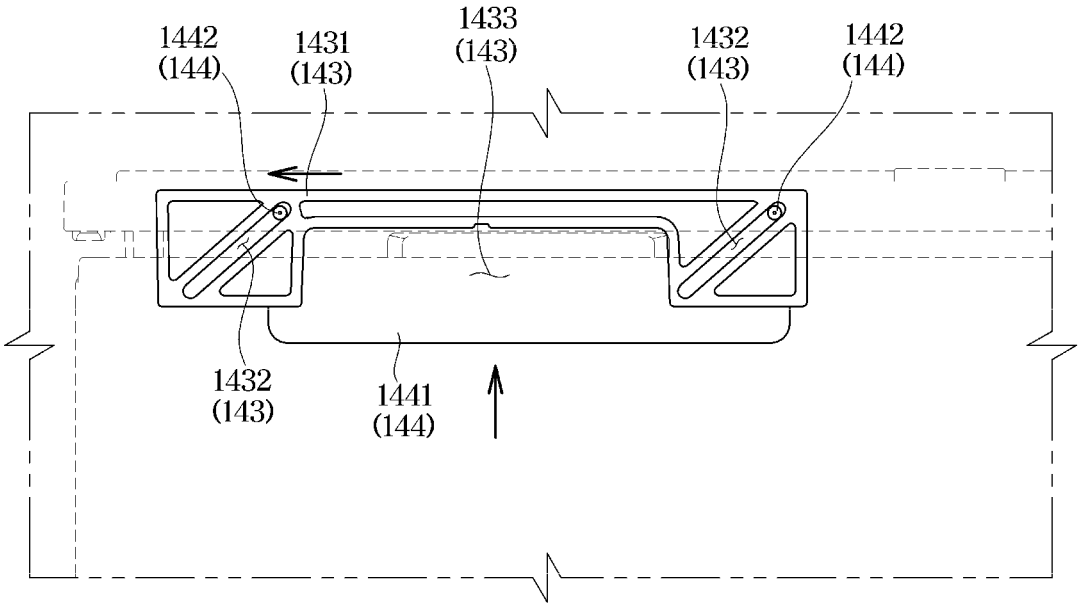
FIG. 15 is a front view illustrating a relationship between the guide member and the opening and closing member in the second state as illustrated in FIG. 12.
Figure 16:
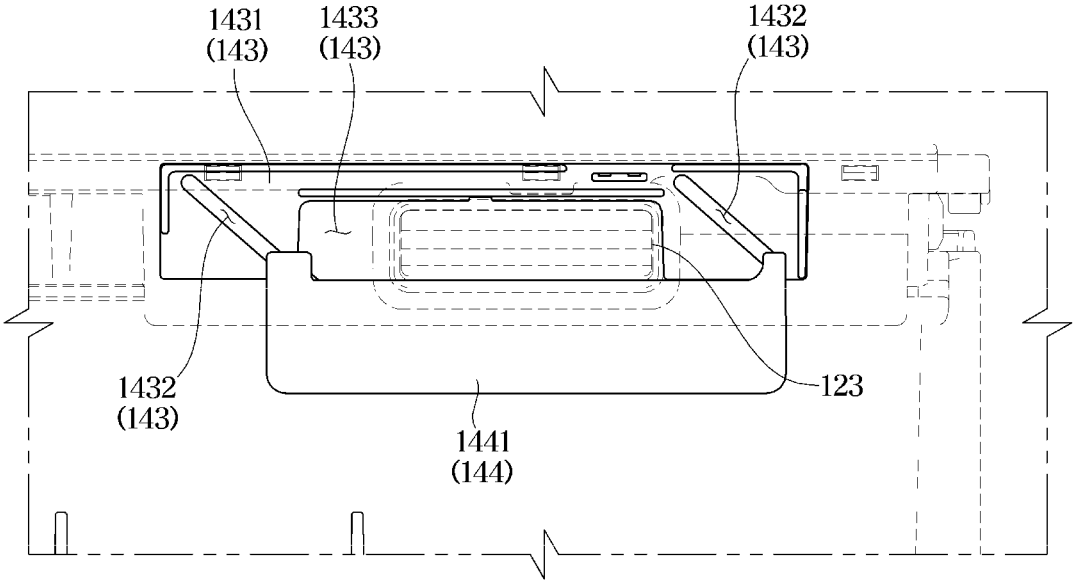
FIG. 16 is a rear view illustrating the relationship between the guide member and the opening and closing member in the first state as illustrated in FIG. 11.
Figure 17:
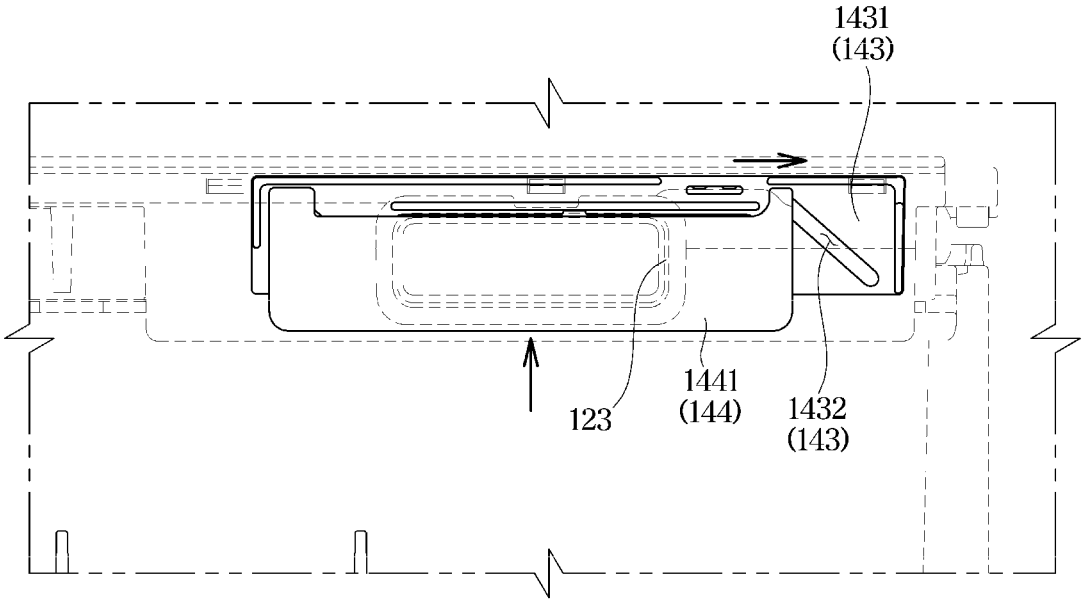
FIG. 17 is a rear view illustrating the relationship between the guide member and the opening and closing member in the second state as illustrated in FIG. 12.

FIG. 14 is a front view illustrating a relationship between the guide member and the opening and closing member in the first state as illustrated in FIG. 11. FIG. 15 is a front view illustrating a relationship between the guide member and the opening and closing member in the second state as illustrated in FIG. 12. FIG. 16 is a rear view illustrating the relationship between the guide member and the opening and closing member in the first state as illustrated in FIG. 11. FIG. 17 is a rear view illustrating the relationship between the guide member and the opening and closing member in the second state as illustrated in FIG. 12.

Referring to FIG. 14, in the first state, the opening and closing member 144 is moved downward with respect to the guide member 143. Referring to FIG. 15, in the second state, the opening and closing member 144 is moved upward with respect to the guide member 143. The movement of the opening and closing member 144 is performed as the interference protrusion 1442 of the opening and closing member 144 is inserted into the guide hole 1432 of the guide member 143.

Particularly, in the first state, the interference protrusion 1442 of the opening and closing member 144 is located at the lowermost end of the guide hole 1432 of the guide member 143. In this case, the opening and closing member 144 is in a state that does not cover the communicator 1433 of the guide member 143.

In response to the manipulation of the knob 141 in the horizontal direction to change from the first state to the second state by a user, the guide member 143 also may be moved in the horizontal direction in conjunction with the movement of the knob 141. Particularly, in response to the knob 141 being moved to the right with reference to the front by a user, the guide member 143 may be moved to the left by the connecting member 142.

In response to the left movement of the guide member 143, the interference protrusion 1442 of the opening and closing member 144 inserted into the guide hole 1432 may be moved to the inside of the guide hole 1432. Particularly, the horizontal movement of the opening and closing member 144 is limited by the slit 1200 and the fixing rib 1210. Accordingly, in response to the movement of the guide member 143, the interference protrusion 1442 and the sealing plate 1441 connected thereto may be moved in the vertical direction along the shape of the guide hole 1432.

Accordingly, the second state in which the sealing plate 1441 of the opening and closing member 144 closes the first opening 123 may be implemented.

Referring to FIG. 16, in the first state, the opening and closing member 144 opens the first opening 123 when the cover unit 100 is viewed from the rear. Particularly, it is a state in which the opening and closing member 144 opens the first opening 123 on an inner side of the outer wall 1291 of the first frame 120 in which the first opening 123 is formed.

Referring to FIG. 17, in the second state, the opening and closing member 144 closes the first opening 123 when the cover unit 100 is viewed from the rear side. Particularly, in response to the knob 141 being moved to the right to change from the first state corresponding to the dual mode, to the second state corresponding to the single mode by a user, the guide member 143 may be moved to the right with respect to the rear side.

In response to the right movement of the guide member 143, the interference protrusion 1442 of the opening and closing member 144 inserted into the guide hole 1432 may be moved to the inside of the guide hole 1432. As described above, the interference protrusion 1442 may be moved along the shape of the guide hole 1432, and the sealing plate 1441 connected to the interference protrusion 1442 may be moved upward together in the vertical direction.

In other words, the guide member 143 may be provided to be moved in a first direction inside the frame. The guide hole 1432 formed in the guide member 143 may be inclined in a second direction different from the first direction. The opening and closing member 144 may be provided to be moved in a third direction different from the first and second directions by being partially inserted into the guide hole 1432.

The first direction is a horizontal direction, the second direction is a direction having an inclination with respect to the horizontal direction, and the third direction is a vertical direction perpendicular to the horizontal direction.

Figure 18:
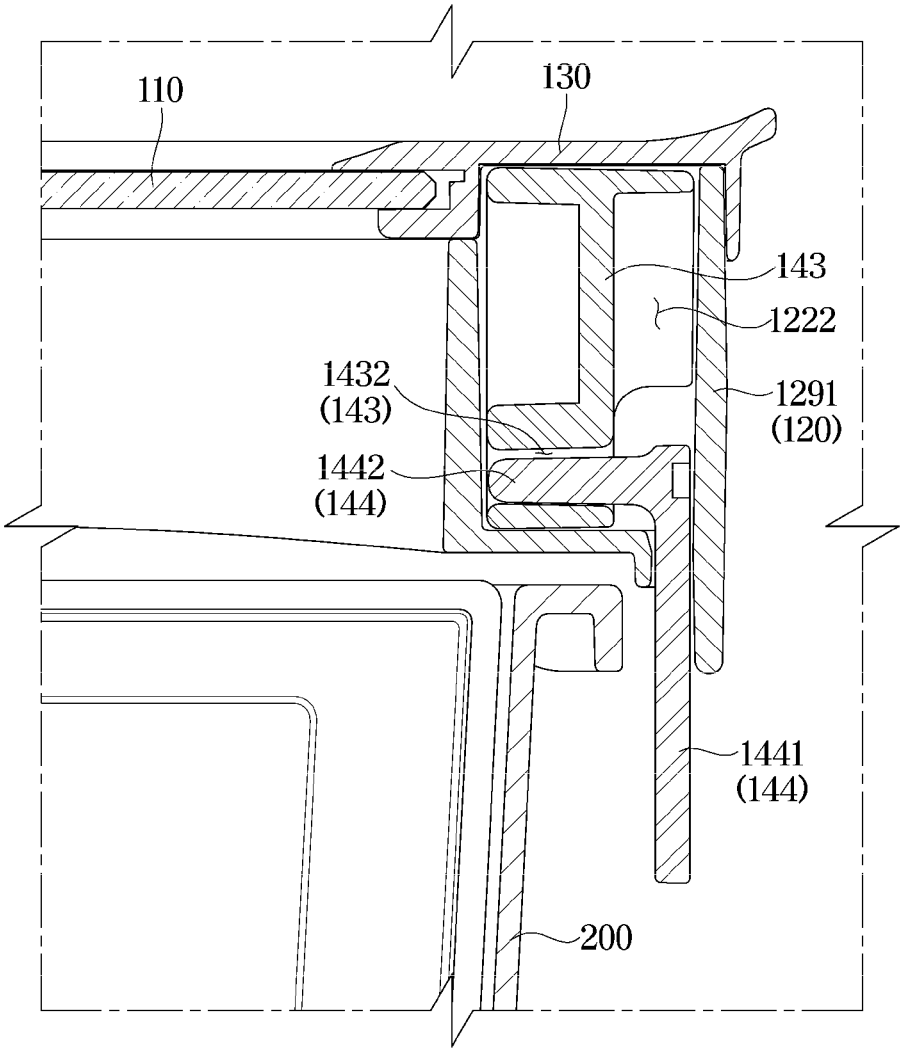
FIG. 18 is a cross-sectional view illustrating a relationship between the cover unit and the storage box in the first state as illustrated in FIG. 11.
Figure 19:
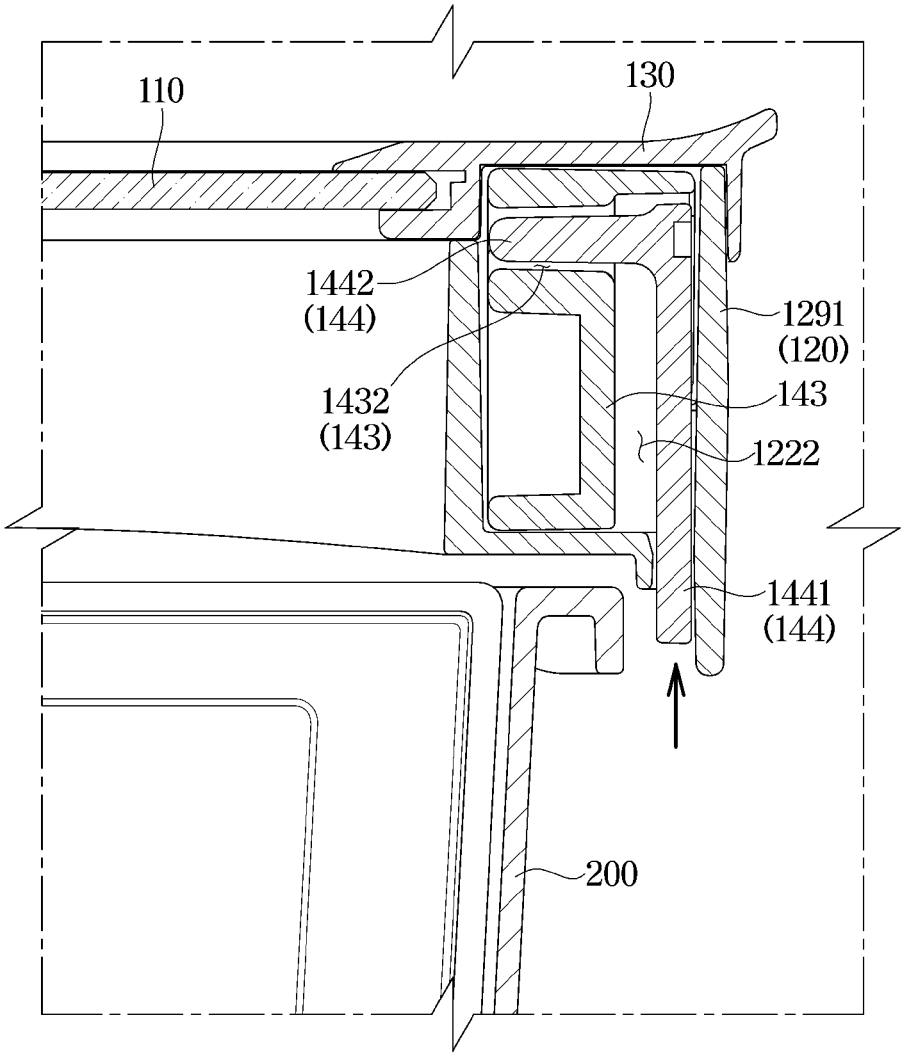
FIG. 19 is a cross-sectional view illustrating the relationship between the cover unit and the storage box in the second state as illustrated in FIG. 12.

FIG. 18 is a cross-sectional view illustrating a relationship between the cover unit and the storage box in the first state as illustrated in FIG. 11. FIG. 19 is a cross-sectional view illustrating the relationship between the cover unit and the storage box in the second state as illustrated in FIG. 12.

Referring to FIGS. 18 and 19, the opening and closing member 144 may be inserted into the guide member 143 to be moved in the vertical direction. FIG. 18 illustrates a state in which the opening and closing member 144 is lowered in the first state, and FIG. 19 illustrates a state in which the opening and closing member 144 is raised in the second state. In this case, the opening and closing member 144 is in the state of closing the first opening 123.

In order to open and close the first opening 123 of the frame, the opening and closing member 144 may be coupled to the rear of the guide member 143 to be moved up and down between the guide member 143 and the outer wall 1291 of the first frame 120.

In addition, the opening and closing member 144 may be provided to be moved in the vertical direction at the rear of the storage box 200. Therefore, the vertical movement of the opening and closing member 144 may not be exposed to the user. Therefore, even if the size of the opening and closing member 144 is increased to correspond to the size of the first opening 123, the aesthetic of the inside of the refrigerator is not degraded.

The knob 141 of the cold air regulator 140 of the refrigerator 1 according to one embodiment of the present disclosure may be provided to be movable inside the knob through hole 131 formed in the frame. Accordingly, because the knob 141 is provided to be movable relative to the frame by a length at which the knob through hole 131 is cut out, the movement distance of the knob 141 may be limited within the length defined by the knob through hole 131.

That is, as the horizontal movement of the knob 141 is limited, the distance of the horizontal movement of the connecting member 142 and the guide member 143 connected to the knob 141 may also be limited.

Accordingly, the opening and closing member 144 of the refrigerator 1 according to one embodiment of the present disclosure is provided to be movable in the vertical direction with respect to the guide member 143, and thus the opening and closing member 144 may have an opening and closing area independent of the horizontal displacement of the knob 141.

Accordingly, even when the first opening 123 is cut wider along the extension direction of the frame, there is no difficulty in opening and closing the first opening 123 as the size of the opening and closing member 144 is formed in accordance with the size of the first opening 123. In this case, regardless of the size of the first opening 123, the size of the knob through hole 131 may be maintained constant, and thus that the user operation convenience may be increased.

In addition, the user can adjust the opening degree of the first opening 123 at the front of the cover member 110, and thus the user convenience may be increased.

Further, because the cold air regulator 140 is moved along the rim of the cover member 110, the exterior of the cover member 110 may be neatly formed, thereby increasing the aesthetic of the inside of the refrigerator.

In addition, the view of the lower side of the cover member 110 is not obstructed, and thus the user can easily check the items stored under the cover member 110.

In the structure of the above-described cold air regulator 140, it is described that the guide member 143 is connected to the connecting member 142, and the opening and closing member 144 is moved in the vertical direction along the guide hole 1432 formed in the guide member 143.

However, the operation of the cold air regulator 140 is not limited thereto, and the guide hole 1432 may be formed in the outer wall 1291 or the inner wall 1292 of the first frame 120, and the opening and closing member 144 may be directly inclinedly moved along the guide hole 1432 of the first frame 120. In this case, the opening and closing member 144 may be directly connected to the connecting member 142 without the separate guide member 143. Further, the opening and closing member 144 may be directly connected to the first frame 120. An end of the connecting member 142 connected to the opening and closing member 144 is bent in the same direction as the cutting direction of the guide hole 1432, thereby sufficiently assisting the movement of the opening and closing member 144.

Figure 20:
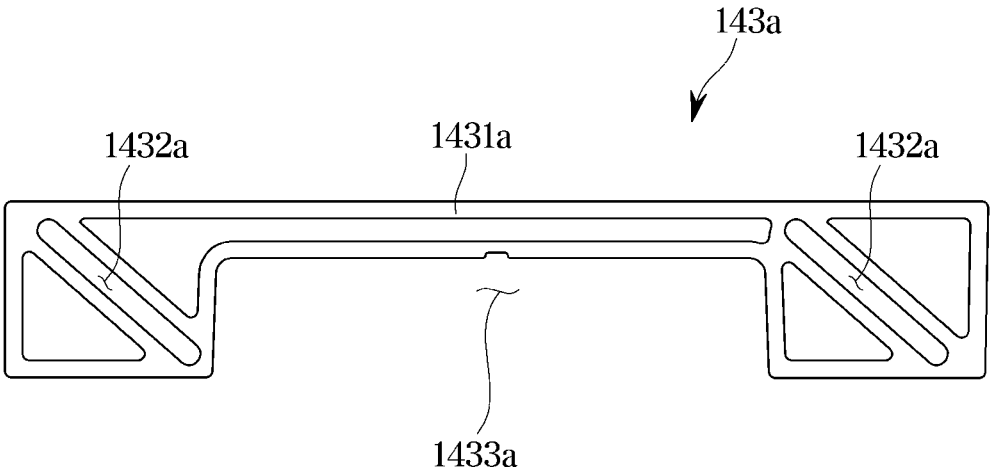
FIG. 20 is a view illustrating a guide member of a refrigerator according to another embodiment of the present disclosure.

FIG. 20 is a view illustrating a guide member of a refrigerator according to another embodiment of the present disclosure.

Hereinafter differences from the guide member 143 of the refrigerator 1 according to one embodiment of the present disclosure will be mainly described. A configuration without a separate description may be provided in the same manner as that of the refrigerator 1 according to one embodiment of the present disclosure, and the same reference numerals may be used. Particularly, the configuration of the opening and closing member 144 coupled to the guide member 143 may be the same as that of the opening and closing member 144 of the refrigerator 1 according to one embodiment of the present disclosure.

Referring to FIG. 20, a guide member 143*a* of a refrigerator 1 according to another embodiment of the present disclosure may include a body 1431*a* including a communicator 1433*a* and a guide hole 1432*a* cut in the body 1431*a*.

The guide hole 1432*a* may be cut from an upper portion of one side of the guide member 143*a* toward a lower portion of the other side.

Unlike the guide member 143 of the refrigerator 1 according to one embodiment of the present disclosure, as the cutting direction is formed in the opposite direction, the operation of the opening and closing member 144 coupled to the guide member 143*a* may be reversed.

For example, in response to the knob 141 being moved from left to right with respect to the front of the first frame 120, the guide member 143*a* may be moved from right to left with respect to the first frame 120.

In response to the guide member 143*a* being moved from right to left, the interference protrusion 1442 of the opening and closing member 144 inserted into the guide hole 1432*a* may be moved from an upper portion of the guide hole 1432*a* to a low portion. That is, the opening and closing member 144 descends with respect to the guide member 143*a* to open the first opening 123.

Conversely, in response to the knob 141 being moved from right to left with respect to the front of the first frame 120, the guide member 143*a* may be moved from left to right with respect to the first frame 120.

In response to the guide member 143*a* being moved from left to right, the interference protrusion 1442 of the opening and closing member 144 inserted into the guide hole 1432*a* may be moved from the lower portion of the guide hole 1432*a* to the upper portion. That is, the opening and closing member 144 rises with respect to the guide member 143*a* to close the first opening 123.

Figure 21:
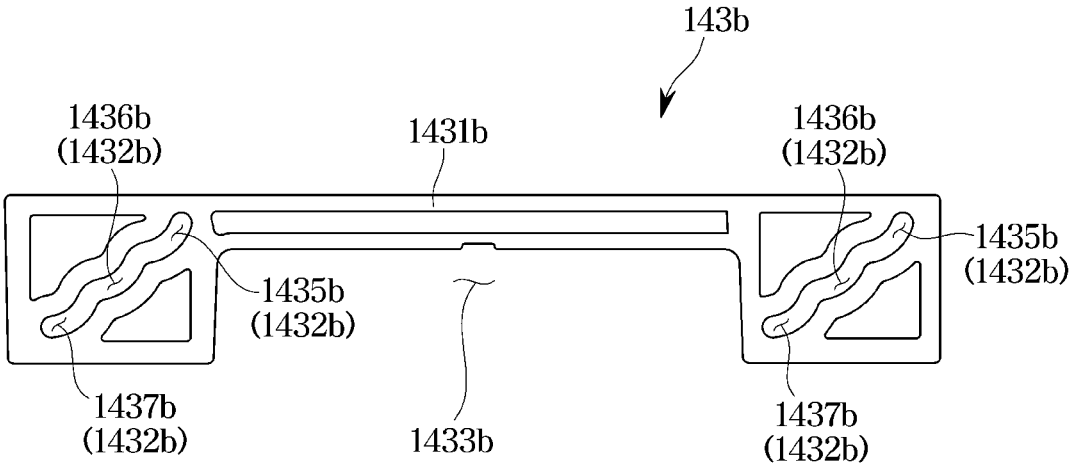
FIG. 21 is a view illustrating a guide member of a refrigerator according to still another embodiment of the present disclosure.

FIG. 21 is a view illustrating a guide member of a refrigerator according to still another embodiment of the present disclosure.

Referring to FIG. 21, a guide member 143*b* of a refrigerator 1 according to still another embodiment of the present disclosure may include a body 1431*b* including a communicator 1433*b* and a guide hole 1432*b* cut in the body 1431*b*.

The guide hole 1432*b* may be cut from a lower portion of one side of the guide member 143*b* toward an upper portion of the other side.

Unlike the guide member 143 of the refrigerator 1 according to one embodiment of the present disclosure, the guide member 143*b* of the refrigerator 1 according to still another embodiment of the present disclosure may include the guide hole 1432*b* including a plurality of curved portions.

The interference protrusion 1442 of the opening and closing member 144 is a component that is provided to be inserted into the guide hole 1432*b* of the guide member 143*b* to move, and thus the interference protrusion 1442 may be moved based on a shape of the guide hole 1432*b*.

Accordingly, because the guide hole 1432*b* of the guide member 143*b* includes a plurality of curved portions 1435*b*, 1436*b*, and 1437*b*, the interference protrusion 1442 inserted therein may be moved step by step. This acts as a kind of resistance and is transmitted to the user in a reverse manner when the user manipulates the knob 141.

Accordingly, because the plurality of curved portions 1435*b*, 1436*b*, and 1437*b* is formed in the guide hole 1432*b*, the user can manipulate the knob 141 step by step. Therefore, a user can manipulate an area in which the opening and closing member 144 opens the first opening 123 step by step. That is, it is possible to implement the temperature inside the storage box 200 step by step through level 1, level 2, and level 3.

In addition, the shape of the guide hole 1432*b* may vary as long as the guide hole 1432*b* generates a resistance force. For example, the guide member 143*b* may include a protrusion protruding to the inside of the guide hole 1432*b*. Therefore, when the user manipulates the knob 141, the interference protrusion 1442 of the opening and closing member 144 and the protrusion of the guide member 143*b* interfere with each other and resistance occurs, and thus it is possible to implement the temperature inside the storage box 200 step by step.

Figure 22:
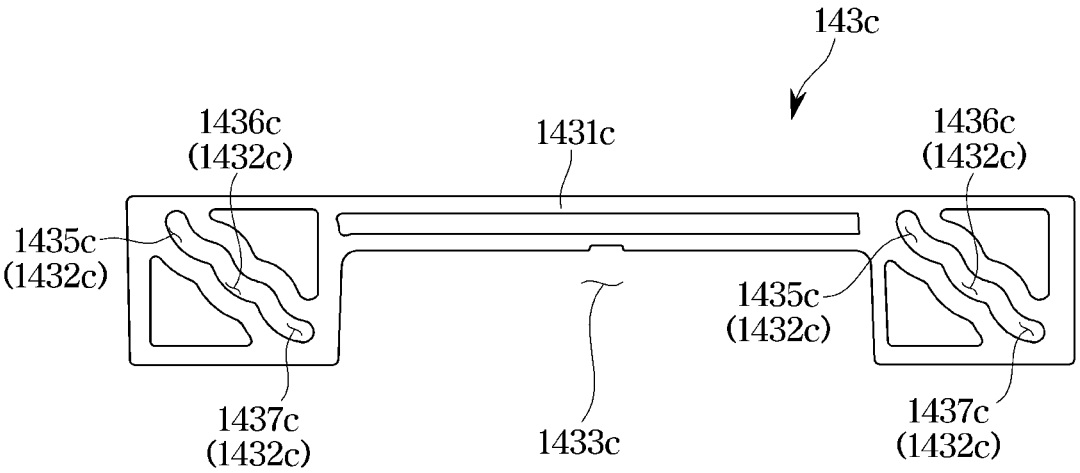
FIG. 22 is a view illustrating a guide member of a refrigerator according to still another embodiment of the present disclosure.

FIG. 22 is a view illustrating a guide member of a refrigerator according to still another embodiment of the present disclosure.

A guide member 143*c* of a refrigerator 1 according to still another embodiment of the present disclosure may include a body 1431*c* including a communicator 1433*c* and a guide hole 1432*c* cut in the body 1431*c*.

Further, the guide member 143*c* may include a guide hole 1432*c* including a plurality of curved portions 1435*c*, 1436*c*, and 1437*c*.

Unlike the guide member 143*b* of the refrigerator 1 according to another embodiment of the present disclosure, the guide hole 1432*c* may be cut from an upper portion of one side of the guide member 143*c* toward a lower portion of the other side.

Accordingly, the operation of the opening and closing member 144 of the refrigerator 1 according to still another embodiment of the present disclosure may be operated opposite to that of FIG. 21.

While the present disclosure has been particularly described with reference to exemplary embodiments, it should be understood by those of skilled in the art that various changes in form and details may be made without departing from the spirit and scope of the present disclosure.

What is claimed is:

1. A refrigerator comprising:

a storage compartment to receive cold air through a discharge port;

a storage box configured to store items; and a cover assembly provided over the storage box, wherein the cover assembly includes:

a cover member configured to cover an upper portion of the storage box;

a frame provided along a rim of the cover member and configured to fix the cover member to the storage compartment, the frame having an opening to communicate with the discharge port to allow the cold air to flow into the storage box;

a knob configured to be movable and disposed on a side of the frame;

a connecting member configured to be slidable inside the frame and connected to the knob;

a guide member configured to be movable inside the frame based on a movement of the knob, the guide member having a guide hole; and an opening and closing member configured to open and close the opening of the frame based on the opening and closing member moving in a vertical direction along the guide hole of the guide member.

2. The refrigerator of claim 1, wherein the guide member comprises:

a body having a communicator to communicate with the opening, and the guide hole is formed in the body and inclined with respect to the storage compartment.

3. The refrigerator of claim 2, wherein the opening and closing member comprises:

a sealing plate to open and close the opening; and an interference protrusion formed to extend from the sealing plate toward the guide member, the interference protrusion being insertable into the guide hole and moveable along the guide hole.

4. The refrigerator of claim 2, wherein the opening and closing member interferes with the guide hole so that the opening and closing member is vertically moved with respect to the frame based on a horizontal movement of the guide member.

5. The refrigerator of claim 1, wherein the frame comprises a slit formed on a bottom surface to allow the opening and closing member to pass therethrough and to be moved to an outside of the frame.

6. The refrigerator of claim 5, wherein the frame further comprises a fixing rib formed at both ends of the slit and extending from the bottom surface to prevent a lateral movement of the opening and closing member.

7. The refrigerator of claim 1, wherein the frame comprises:

an accommodating space formed by an inner wall, an outer wall, and a pair of partition walls to accommodate the guide member and the opening and closing member.

8. The refrigerator of claim 7, wherein the opening of the frame comprises:

a first opening formed in the outer wall of the frame; and a second opening formed in the inner wall of the frame.

9. The refrigerator of claim 8, wherein the opening and closing member is provided to be movable up and down between the guide member and the outer wall of the frame so as to open and close the first opening of the frame.

10. The refrigerator of claim 1, wherein the storage box further comprises a divider provided inside the storage box to divide an inside into a plurality of spaces.

11. The refrigerator of claim 10, wherein one of the plurality of spaces of the storage box is provided to selectively receive the cold air from the discharge port and the opening.

12. The refrigerator of claim 10, wherein the opening and closing member is configured to be movable up and down along a rear side of the storage box.

13. The refrigerator of claim 3, wherein the guide hole comprises a plurality of curved portions to allow the interference protrusion of the opening and closing member to be inserted into the guide hole to adjust an area for opening.

14. The refrigerator of claim 1, wherein the frame comprises:

a first frame in which the connecting member, the guide member, and the opening and closing member are accommodated; and a second frame coupled to an upper portion of the first frame.

15. The refrigerator of claim 14, wherein the first frame comprises a guide rib formed to extend toward the connecting member to allow the connecting member to move in contact with an inner surface of the first frame.

* * * * *